US012049907B2

(12) United States Patent
Hu et al.

(10) Patent No.: US 12,049,907 B2
(45) Date of Patent: Jul. 30, 2024

(54) HEATING PUMP AND CLEANING DEVICE WITH SAME

(71) Applicants: Guangdong Midea White Home Appliance Technology Innovation Center Co., Ltd., Foshan (CN); Midea Group Co., Ltd., Foshan (CN)

(72) Inventors: Xiaowen Hu, Foshan (CN); Site Hu, Foshan (CN); Longzhen Dai, Foshan (CN); Fagang Tan, Foshan (CN); Richao Liu, Foshan (CN)

(73) Assignees: Guangdong Midea White Home Appliance Technology Innovation Center Co., Ltd., Foshan (CN); Midea Group Co., Ltd., Foshan (CN)

( * ) Notice: Subject to any disclaimer, the term of this patent is extended or adjusted under 35 U.S.C. 154(b) by 69 days.

(21) Appl. No.: 17/680,227

(22) Filed: Feb. 24, 2022

(65) Prior Publication Data

US 2022/0178384 A1 Jun. 9, 2022

Related U.S. Application Data

(63) Continuation of application No. PCT/CN2019/124080, filed on Dec. 9, 2019.

(30) Foreign Application Priority Data

Sep. 3, 2019 (CN) ..... 201910827545.2
Sep. 3, 2019 (CN) ..... 201910829519.3

(51) Int. Cl.
*F04D 29/58* (2006.01)
*A47L 15/42* (2006.01)
(Continued)

(52) U.S. Cl.
CPC ..... *F04D 29/586* (2013.01); *A47L 15/4225* (2013.01); *A47L 15/4285* (2013.01);
(Continued)

(58) Field of Classification Search
CPC .... F04D 29/586; F04D 29/043; F04D 29/426; F04D 29/588; F04D 1/00; A47L 15/4225; A47L 15/4285; D06F 39/04; D06F 39/085
See application file for complete search history.

(56) References Cited

U.S. PATENT DOCUMENTS 4,806,083 A 2/1989 LaGrange et al.
2001/0008135 A1* 7/2001 Gaston ..... F02M 37/106 123/518
(Continued)

FOREIGN PATENT DOCUMENTS

AU 666103 B3 1/1996
CN 1076512 A 9/1993
(Continued)

OTHER PUBLICATIONS

White Home Technology Innovation Center in Guangdong America, Inc., First Office Action, CN Application No. 201910829519.3, Apr. 21, 2021, 8 pgs.
(Continued)

*Primary Examiner* — Courtney D Heinle
*Assistant Examiner* — Andrew Thanh Bui
(74) *Attorney, Agent, or Firm* — Morgan, Lewis & Bockius LLP

(57) ABSTRACT

A heating pump includes a driving electric motor; a pump case, wherein a pump cavity and a heating cavity are defined in the pump case, the pump cavity and the heating cavity are roughly arranged side by side in an axial direction and are in communication by means of a communication channel,
(Continued)

and a water inlet and a water outlet are formed in the pump case; an impeller arranged in the pump cavity; and a heating member arranged in the heating cavity. Therefore, not only is the size of the heating pump favorably reduced, the impeller may also be prevented from being radiated at a temperature by the heating member, such that the premature aging of the impeller may be prevented, and thus, the usage performance of the heating pump may be improved.

18 Claims, 15 Drawing Sheets

(51) Int. Cl.
*D06F 39/04* (2006.01)
*F04D 29/043* (2006.01)
*F04D 29/42* (2006.01)

(52) U.S. Cl.
CPC ..... *D06F 39/04* (2013.01); *F04D 29/043* (2013.01); *F04D 29/426* (2013.01)

(56) References Cited

U.S. PATENT DOCUMENTS

| | | | | |
|---|---|---|---|---|
| 2004/0026411 | A1* | 2/2004 | Mucke | A47L 15/4285 219/543 |
| 2007/0143914 | A1* | 6/2007 | Shirai | F24H 9/1818 4/420.2 |
| 2010/0108110 | A1* | 5/2010 | Ryu | A47L 15/4285 134/184 |
| 2010/0322761 | A1* | 12/2010 | Hunjan | F04D 29/426 415/203 |
| 2013/0022455 | A1* | 1/2013 | Weber | F04D 29/445 415/206 |
| 2015/0337859 | A1* | 11/2015 | Qi | F04D 29/426 415/177 |

FOREIGN PATENT DOCUMENTS

| | | | |
|---|---|---|---|
| CN | 1752463 | A | 3/2006 |
| CN | 102108972 | H | 6/2011 |
| CN | 102400959 | A | 4/2012 |
| CN | 103089710 | A | 5/2013 |
| CN | 103477085 | A | 12/2013 |
| CN | 103557156 | A | 2/2014 |
| CN | 104023613 | A | 9/2014 |
| CN | 104718381 | A | 6/2015 |
| CN | 105090127 | A | 11/2015 |
| CN | 206035897 | U | 3/2017 |
| CN | 108194422 | A | 6/2018 |
| DE | 29901065 | U1 | 4/1999 |
| DE | 10325981 | A1 | 12/2004 |
| DE | 102011003464 | A1 | 4/2012 |
| JP | 10103297 | H | 4/1998 |
| JP | 2000297776 | A | 10/2000 |
| JP | 2002195598 | A | 7/2002 |
| JP | 2003097495 | A | 4/2003 |
| JP | 2003214377 | A | 7/2003 |
| JP | 2006177329 | A | 7/2006 |
| KR | 20190002922 | A | 1/2019 |

OTHER PUBLICATIONS

White Home Technology Innovation Center in Guangdong America, Inc., The Second Office Action, CN Application No. 201910829519.3, Oct. 8, 2021, 7 pgs.
Guangdong Meidi White Household Appliances Technology Innovation Center Co., Ltd., First Office Action, CN Application No. 201910827545.2, Apr. 1, 2020, 5 pgs.
Guangdong Meidi White Household Appliances Technology Innovation Center Co., Ltd, The Second Office Action, CN Application No. 201910827545.2, Sep. 21, 2020, 6 pgs.
Guangdong Midea White Goods Technology Innovation Center Co., Ltd. Midea Group Co., Ltd., Decision of Rejection, CN Application No. 201910827545.2, Mar. 11, 2021, 7 pgs.
Guangdong Midea White Goods Technology Innovation Center Co., Ltd., International Search Report, PCT/CN2019/124080, May 28, 2020, 10 pgs.
Midea Group Co., Ltd., Extended European Search Report and Supplementary Search Report, EP19944628.7, Sep. 19, 2022, 7 pgs.
Midea Group Co., Ltd., WO, PCT/CN2019/124080, May 28, 2020, 4 pgs.
Midea Group Co., Ltd., IPRP, PCT/CN2019/124080, Mar. 8, 2022, 5 pgs.

* cited by examiner

HEATING PUMP AND CLEANING DEVICE WITH SAME

CROSS-REFERENCE TO RELATED APPLICATIONS

This application is a continuation of PCT International Application No. PCT/CN2019/124080, filed Dec. 9, 2019, which claims the benefit of the Chinese Patent Application Nos. 201910827545.2 and 201910829519.3, both filed on Sep. 3, 2019, the entire contents of which are incorporated herein by reference.

FIELD

The present disclosure relates to the field of household appliances and, more particularly, to a heating pump and a cleaning device having the same.

BACKGROUND

In technical solutions for washing machines and dishwashers in the related art, heating tubes or thick film are often arranged inside water pump volutes. First of all, dishwasher pumps with heating tubes arranged in pump casings often have large volumes, and a large distance usually remains between the heating tube and the pump casing for the sake of thermal safety requirements, leading to an increase in an outer diameter of the pump casing. However, considering an effective volume rate, the installed water pump often has a smaller height. The existing technical solutions are in certain contradiction to the design requirement for a large volume rate of the dishwashers or washing machines.

SUMMARY

The present disclosure aims to solve at least one of the technical problems existing in the related art. To this end, an objective of the present disclosure is to provide a heating pump that has a reduced volume.

Another objective of the present disclosure is to provide a cleaning device including the above-described heating pump, to solve the technical problems of excessive pump volume and impellers susceptible to heat aging.

A heating pump according to embodiments of a first aspect of the present disclosure includes: a drive motor; a pump casing defining a pump cavity and a heating cavity in communication with the pump cavity, the pump cavity and the heating cavity being substantially arranged side by side in an axial direction, the pump cavity and the heating cavity being in communication with each other through a communication channel, and the pump casing being formed with a water inlet in communication with the pump cavity and a water outlet in communication with the heating cavity; an impeller arranged in the pump cavity and coupled to a motor shaft of the drive motor; and a heating member arranged within the heating cavity.

For the heating pump according to the embodiments of the present disclosure, by arranging the pump cavity substantially side by side with the heating cavity in the axial direction, arranging the impeller within the pump cavity, and making the heating cavity in communication with the pump cavity through the communication channel, the volume of the heating pump can be reduced, and the high-temperature radiation from the heating member to the impeller can be avoided, to prevent the premature aging of the impeller and improve the performance of the heating pump.

In addition, the heating pump according to the above embodiments of the present disclosure has the following additional technical features.

According to some embodiments of the present disclosure, the communication channel extends tangentially along an inner wall surface of the pump casing.

Further, the communication channel is an expansion channel in a water flow direction, and an expansion angle of the expansion channel is not greater than 20 degrees.

According to some embodiments of the present disclosure, in the direction of flow of water, the pump cavity includes an inlet connection section and a water pump volute, the expansion channel being formed between the water pump volute and the heating cavity.

In some embodiments of the present disclosure, the pump casing includes an outlet connection tube in communication with the heating cavity, and a free end of the outlet connection tube forms the water outlet.

Further, the outlet connection tube extends tangentially along an outer side wall of the heating cavity.

Further, the heating cavity includes a first mounting groove at a bottom of the heating cavity, and a first seal member is arranged in the first mounting groove.

According to some embodiments of the present disclosure, the heating member is a heating tube extending spirally, and a spiral direction of the heating tube is consistent with a water flow direction.

In some embodiments of the present disclosure, the heating member is a thick film on an inner wall surface of the heating cavity.

According to some embodiments of the present disclosure, a flow guide rib is arranged on an inner wall surface of the heating cavity, and an extension direction of the flow guide rib is consistent with a water flow direction.

According to some embodiments of the present disclosure, the motor shaft is formed with an outer thread and the impeller is formed with an inner thread; the drive motor and the impeller are coupled by fitting between the outer thread and the inner thread; and a spiral direction of the inner thread/the outer thread is opposite to a rotation direction of the drive motor.

According to some embodiments of the present disclosure, the heating pump further includes an end cap formed with the water inlet, the end cap being hermetically coupled to the pump casing.

Further, the end cap includes: a water inlet end cap, a second seal member being arranged between the water inlet end cap and the pump casing; and a water outlet end cap, a third seal member being arranged between the water outlet end cap and the pump casing. The water inlet end cap includes a mating slot, and the pump casing includes a mating portion fitted in the mating slot; the mating portion includes a second mounting groove for mounting the second seal member, and the water outlet end cap includes a third mounting groove for mounting the third seal member.

In some embodiments of the present disclosure, in a water flow direction, a water inlet channel, a rectification channel, and a mating channel are defined at an inner side of the end cap, and a water inlet end of the water inlet channel forms the water inlet; the impeller is arranged at the mating channel and is spaced apart from an inner wall surface of the mating channel to define a return channel for return water flow between the impeller and the mating channel.

Further, a sealing protrusion is formed on an outer wall surface of the water inlet channel to connect a water inlet hose.

In some embodiments of the present disclosure, in a water flow direction, an inner wall surface of the rectification channel is constructed in a shape with a gradually reduced radial dimension.

Further, the inner wall surface of the rectification channel is constructed in a tapered or arc shape.

According to some embodiments of the present disclosure, a longitudinal section of the communication channel exhibits an axisymmetric shape.

According to some embodiments of the present disclosure, the pump casing has an inner wall surface and an outer wall surface that form the communication channel, and the outer wall surface of the communication channel is tangential to a wall surface of the heating cavity.

According to some embodiments of the present disclosure, the pump casing has an inner wall surface and an outer wall surface that form the communication channel, and at least one of the inner wall surface and the outer wall surface is a flat surface.

According to some embodiments of the present disclosure, the pump casing includes a partition wall separating a whole formed by the pump cavity, the impeller, and a water pump volute of the pump cavity from the heating cavity.

According to some embodiments of the present disclosure, the communication channel is in communication with a top opening of the heating cavity, and the top opening is arranged between the partition wall and a first end of the heating cavity.

According to some embodiments of the present disclosure, the partition wall includes a guide member, the guide member directs liquid from a liquid outlet of the impeller to the water pump volute of the pump cavity, and the guide member forms an inner wall surface of the communication channel.

According to some embodiments of the present disclosure, an axis of the pump cavity is parallel to an axis of the heating cavity.

According to some embodiments of the present disclosure, the heating member extends from a first end of the heating cavity to a second end opposite to the first end, and the water outlet is arranged at the second end of the heating cavity.

According to some embodiments of the present disclosure, an axis of an outlet connection tube of the pump casing is perpendicular to an extension direction of the heating member.

According to some embodiments of the present disclosure, the heating pump further includes an inlet connection tube inserted into the pump cavity and fitting against the pump casing.

A cleaning device according to embodiments of a second aspect of the present disclosure includes the heating pump described above. The cleaning device has a cleaning space for cleaning objects, and a water inflow port of the cleaning space is coupled to the water outlet of the heating pump.

Further, the cleaning device is a washing machine or a dishwasher.

Additional aspects and advantages of embodiments of present disclosure will be given in part in the following descriptions, become apparent in part from the following descriptions, or be learned from the practice of the embodiments of the present disclosure.

BRIEF DESCRIPTION OF DRAWINGS

These and/or other aspects and advantages of embodiments of the present disclosure will become apparent and more readily appreciated from the following descriptions made with reference to the drawings, in which.

Figure 1:
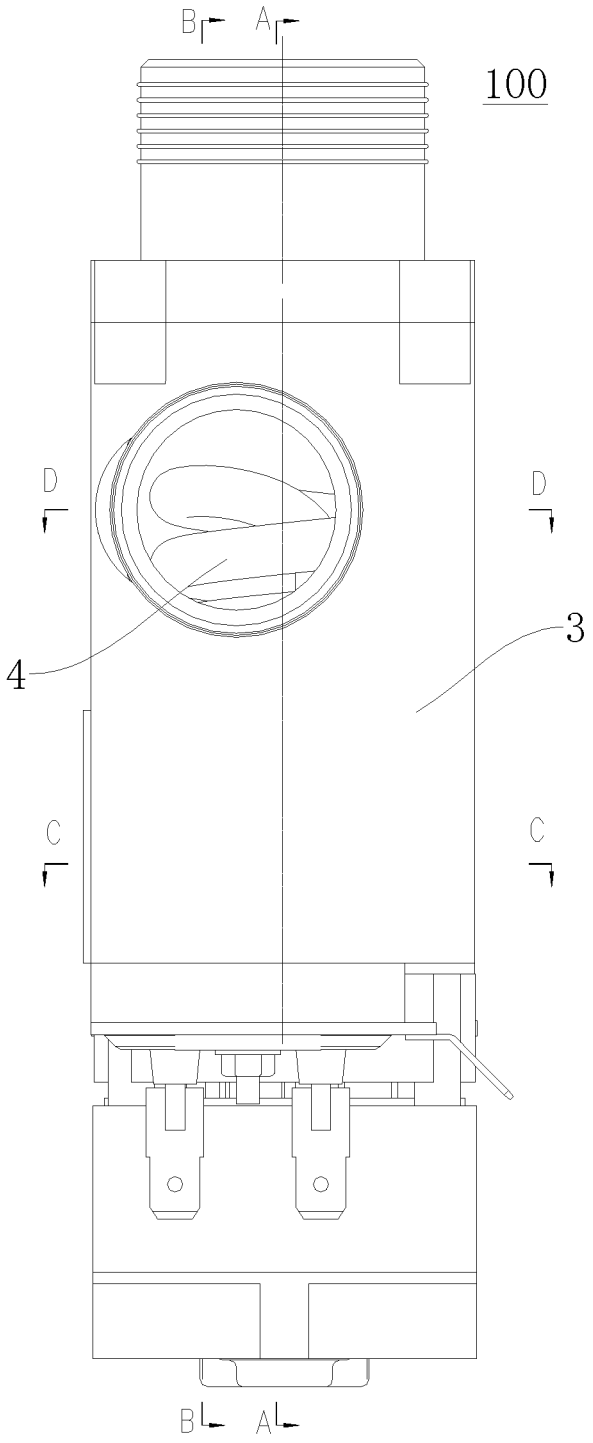
FIG. 1 is a schematic view of a heating pump according to embodiments of the present disclosure.

REFERENCE NUMERALS heating pump 100, drive motor 1, motor shaft 11, pump casing 2, pump cavity 21, inlet connection section 211, water pump volute 212, heating cavity 22, wiring terminal 221, first mounting groove 212, communication channel 23, water outlet 24, outlet connection tube 25, mating section 26, second mounting groove 261, impeller 3, heating member 4, end cap 5, water inlet 51, water inlet end cap 52, mating slot 521, water outlet end cap 53, third mounting groove 531, water inlet channel 54, sealing protrusion 541, rectification channel 55, mating channel 56, return channel 9, flow guide rib 131, inner wall surface 141, outer wall surface 142, partition wall 16, guide member 161.

DETAILED DESCRIPTION OF EMBODIMENTS

Embodiments of the present disclosure will be described below in detail. Examples of the embodiments are illustrated in the accompanying drawings, where the same or similar reference numerals throughout the specification refer to the same or similar elements or elements having the same or similar functions. The embodiments described below with reference to the accompanying drawings are exemplary and are intended to explain the present disclosure rather than limit the present disclosure.

In the related art, dishwashers have a history of about 100 years since their patent applications, and mainly function to automatically clean the tableware. The dishwashers usually have washing, disinfection, drying and other functions, and in order to effectively melt oil and sterilize, washing water is heated up to about 72° C. A separate heating device can be installed inside a water pump or a bottom space of other dishwashers to provide the heated water. Increasingly compact designs of modern dishwashers often have an integral structure of the pump and the heating device, creating a structural requirement for a heating pump.

The schemes in the related art have the following drawbacks. First, the volume is large. Due to the consideration of thermal safety requirements, a large distance is usually reserved between the heating tube and the pump casing, leading to an increase in the outer diameter of the pump casing. However, considering the effective volume rate, the water pump installation often may need to have a smaller height. Such schemes are in certain contradiction to the tendency toward a large volume rate of the dishwashers. Second, for the existing schemes of heating within the pump casing, the heating tube, the plastic impeller, and the volute are close to each other without isolation, which will easily lead to the aging of the pump impeller and the volute under the action of thermal radiation. Third, in the existing schemes, the heating tube is not arranged behind the impeller, and the water flow often moves radially to a wall of the pump casing, easily causing a low flow velocity at a surface of the heating tube and hence an excessively low Reynolds number at the surface of the heating tube, and in turn producing a phenomenon of insufficient surface heat transfer.

A heating pump 100 according to embodiments of the present disclosure will be described below with reference to the accompanying drawings. The heating pump 100 includes an outlet heating device.

Referring to FIG. 1, the heating pump 100 according to embodiments of a first aspect of the present disclosure includes: a drive motor 1, a pump casing 2, an impeller 3, and a heating member 4.

Specifically, in combination with FIGS. 2, 3, 4 and 11, the pump casing 2 defines a pump cavity 21 and a heating cavity 22 in communication with the pump cavity 21. The pump cavity 21 and the heating cavity 22 are substantially arranged side by side in an axial direction. The pump cavity 21 and the heating cavity 22 are in communication with each other through a communication channel 23. The pump casing 2 is formed with a water inlet 51 in communication with the pump cavity 21 and a water outlet 24 in communication with the heating cavity 22.

For example, the pump casing 2 can define the pump cavity 21 and the heating cavity 22 therein. The heating cavity 22 can be in communication with the pump cavity 21. The pump cavity 21 and heating cavity 22 are substantially arranged side by side in the axial direction. An axis of the pump cavity 21 is parallel to and may be spaced apart from an axis of the heating cavity 22. Thus, an overall height of the heating pump 100 is reduced, contributing to decreasing a volume of the heating pump 100.

In some embodiments of the present disclosure, the pump cavity 21 and the heating cavity 22 may be in communication with each other through the communication channel 23, the pump casing 2 may be formed with the water outlet 24, and the water outlet 24 may be in communication with the heating cavity 22.

The impeller 3 is arranged within the pump cavity 21 and the impeller 3 is coupled to a motor shaft 11 of the drive motor 1. For example, the impeller 3 may be, for example, a plastic member. The impeller 3 may be, for example, a centrifugal impeller. The impeller 3 may be arranged within the pump cavity 21, and the impeller 3 may be coupled to the motor shaft 11 of the drive motor 1. Thus, the impeller 3 can be driven to rotate by the drive motor 1.

The heating member 4 can be arranged within the heating cavity 22. In this way, the water flowing through the heating cavity 22 can be heated by providing the heating member 4 in the heating cavity 22.

The heating pump 100 according to embodiments of the present disclosure adopts a design structure in which the heating cavity 22 is substantially arranged side by side with the pump cavity 21 in the axial direction (the impeller 3 is arranged in the pump cavity 21) and the heating cavity 22 is coupled to the pump cavity 21 through the communication channel 23, which helps to reduce the volume of the heating pump 100, and avoids high-temperature radiation from the heating member 4 to the impeller 3. Thus, the impeller 3 will not be prematurely aged due to the thermal radiation from the heating member 4, which may affect the performance of the heating pump 100.

The water flow entering the pump cavity 21 from the water inlet 51 can further flow into the heating cavity 22 through the communication channel 23, and the water flow entering the heating cavity 22 can be heated by the heating member 4, so that the water flow can be output from the water outlet 24 after being heated by the heating member 4, to better meet the needs of users.

For the heating pump 100 according to embodiments of the present disclosure, by arranging the pump cavity 21 substantially side by side with the heating cavity 22 in the axial direction, arranging the impeller 3 within the pump cavity 21, and making the heating cavity 22 in communication with the pump cavity 21 through the communication channel 23, the volume of the heating pump 100 can be reduced, and the high-temperature radiation from the heating member 4 to the impeller 3 can be avoided, to prevent the premature aging of the impeller 3 and improve the performance of the heating pump 100.

Figure 16:
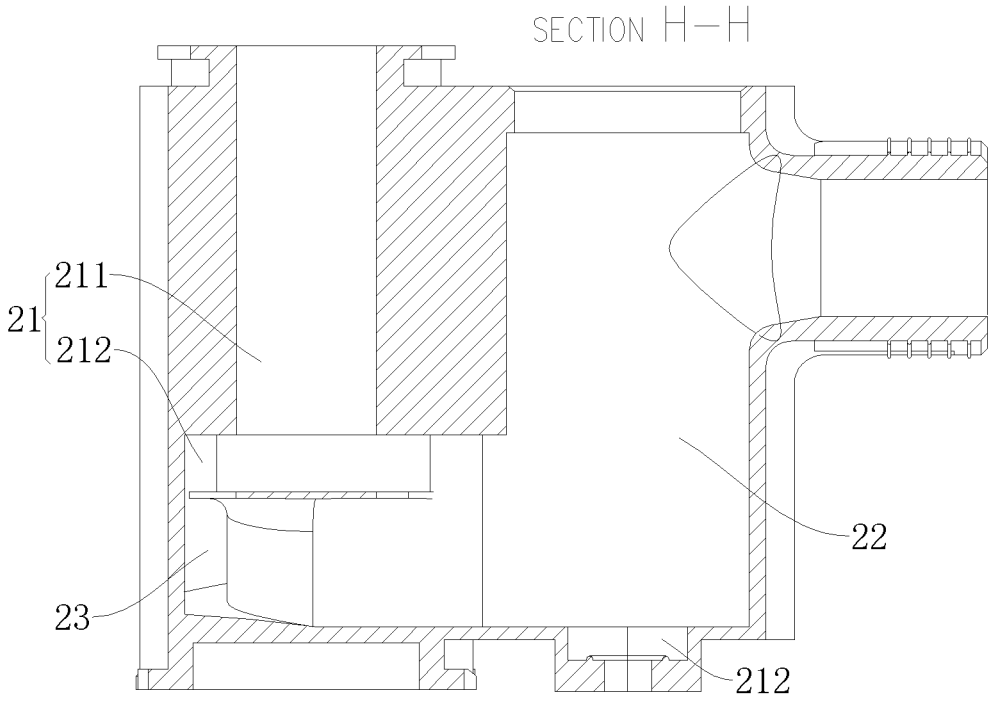
FIG. 16 is a sectional view along line H-H in FIG. 14.
Figure 18:
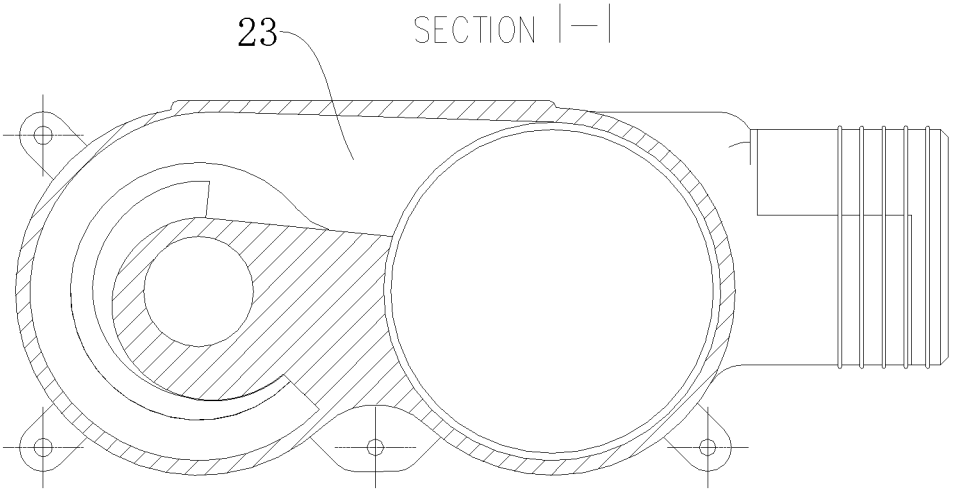
FIG. 18 is a sectional view along line I-I in FIG. 17.

Referring to FIGS. 16 and 18, according to some embodiments of the present disclosure, the communication channel 23 is constructed to extend tangentially along an inner wall surface of the pump casing 2. For example, in some specific embodiments of the present disclosure, the communication channel 23 may be constructed to extend tangentially along the inner wall surface of the pump casing 2. Thus, it is convenient to smoothly introduce air bubbles drawn in by the impeller 3 into the heating cavity 22 instead of accumulating in the pump cavity 21, to avoid noise of the air bubbles. Moreover, the water flow can be introduced into the heating cavity 22 at high speed and swirl along a wall surface of the heating cavity 22, improving the heat transfer performance of the heating member 4.

Certainly, in some embodiments of the present disclosure, the communication channel 23 may not extend tangentially, and the present disclosure does not limit the specific extension way of the communication channel 23, which may be arranged adaptively according to needs in practical applications.

Figure 4:
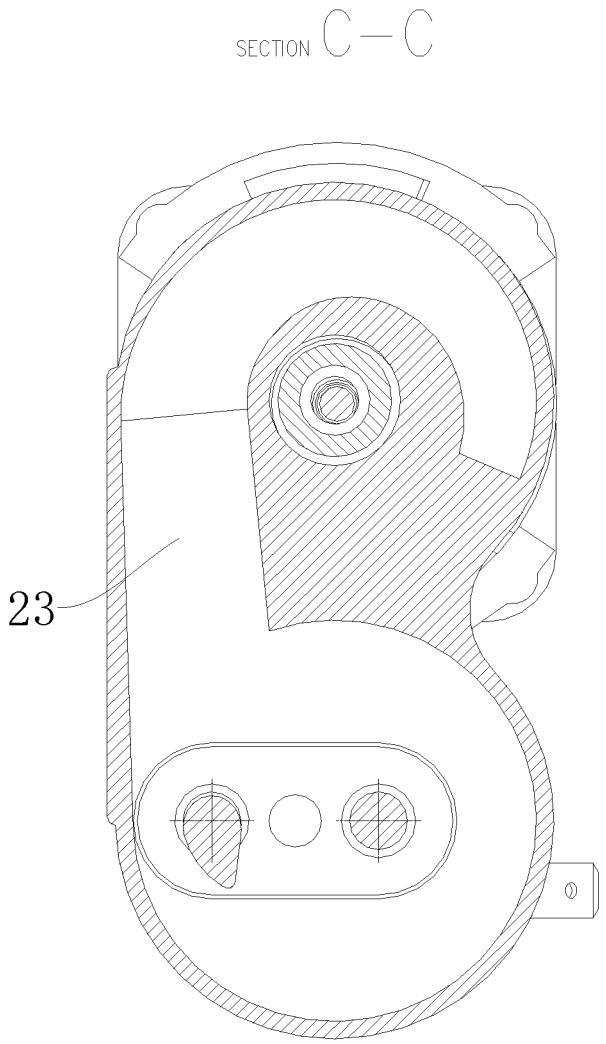
FIG. 4 is a sectional view along line C-C in FIG. 1.
Figure 9:
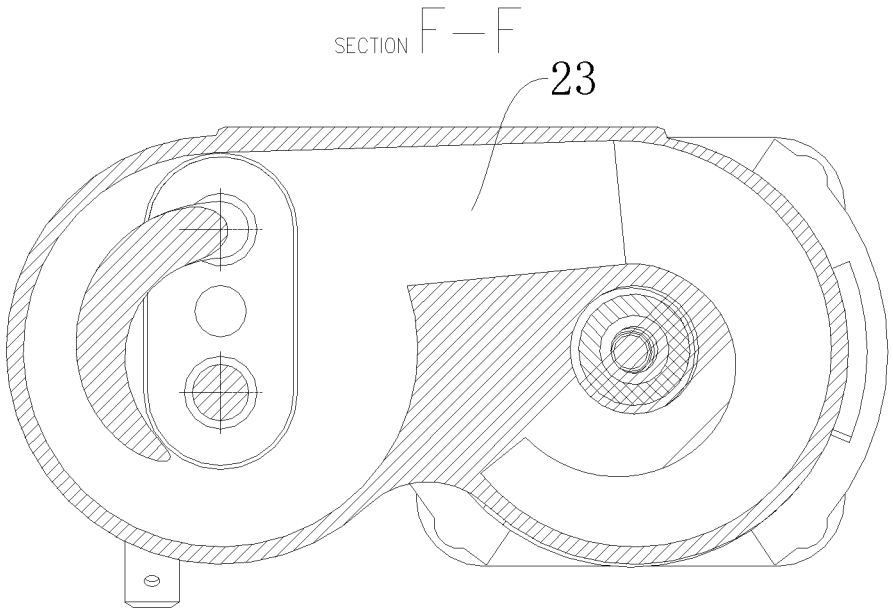
FIG. 9 is a sectional view along line F-F in FIG. 7.

Further, in combination with FIGS. 4 and 9, the communication channel 23 is constructed as an expansion channel in a water flow direction, and an expansion angle of the expansion channel is not greater than 20 degrees. For example, in the water flow direction, a distance L is between two sections perpendicular to the water flow direction, in which an equivalent diameter of one section located on an upstream side is denoted as D1 and an equivalent diameter of the other section located on a downstream side is denoted as D2, and the expansion angle $\alpha=2*\arctan(D2-D1)/L$, i.e., a tangent of half of the expansion angle is equal to $(D2-D1)/L$.

Figure 14:
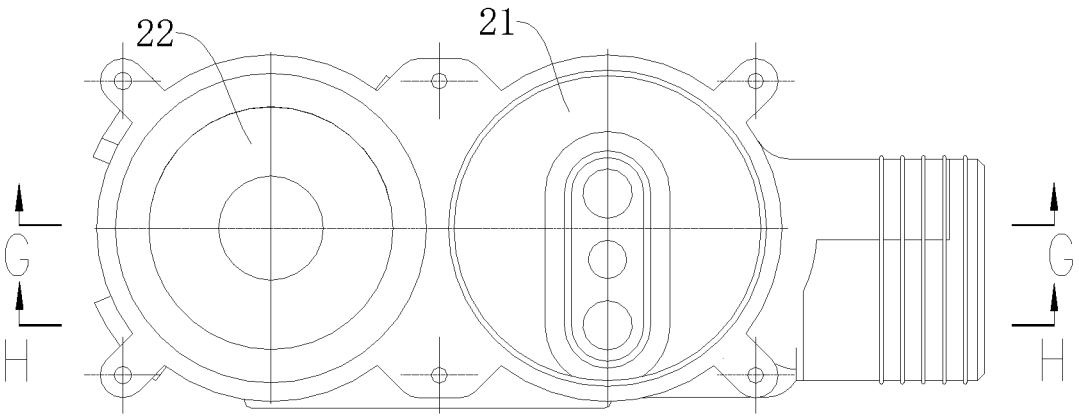
FIG. 14 is another schematic view of a pump casing of the heating pump in FIG. 1 according to embodiments of the present disclosure.
Figure 15:
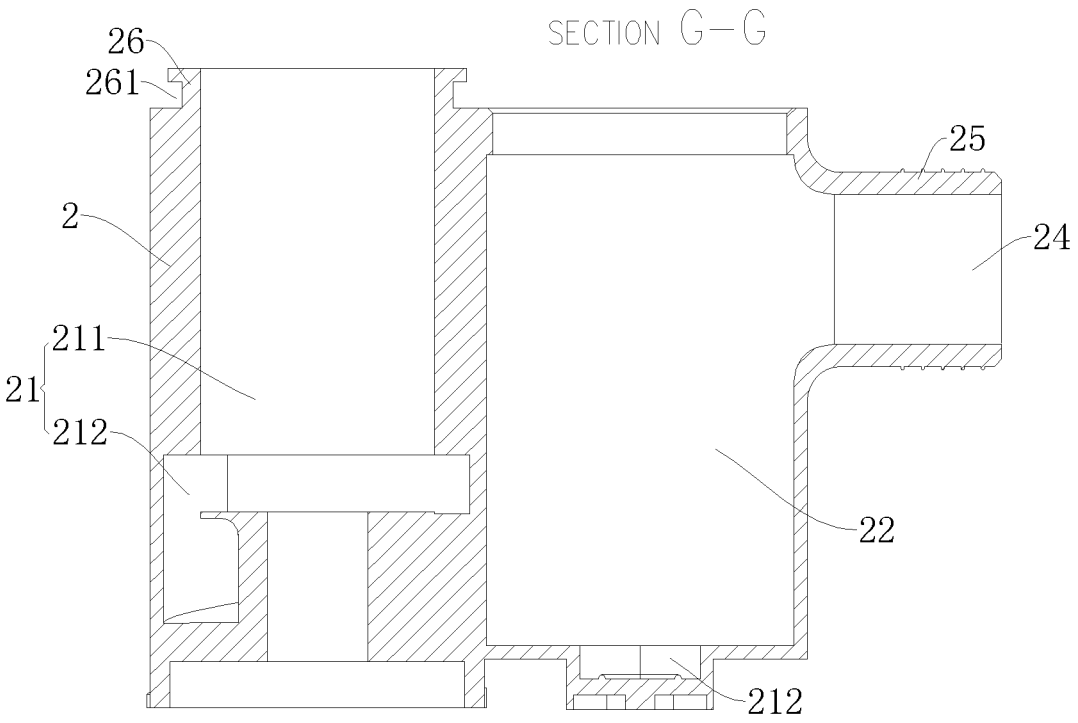
FIG. 15 is a sectional view along line G-G in FIG. 14.

Referring to FIGS. 15 and 16 and in combination with FIG. 14, according to some embodiments of the present disclosure, in the direction of flow of water, the pump cavity 21 includes: an inlet connection section 211 and a water pump volute 212, with the expansion channel 23 formed between the water pump volute 212 and the heating cavity 22. Thus, by providing the expansion channel between the heating cavity 22 and the water pump volute 212, the dynamic pressure at an outlet of the water pump volute 212 can be further recovered, the head of the heating pump 100 can be increased, and the velocity of entering the heating cavity 22 can be reduced, which is conducive to reducing the loss coefficient of the water entering the heating cavity 22, so that the efficiency of the heating pump 100 can be improved.

Figure 2:
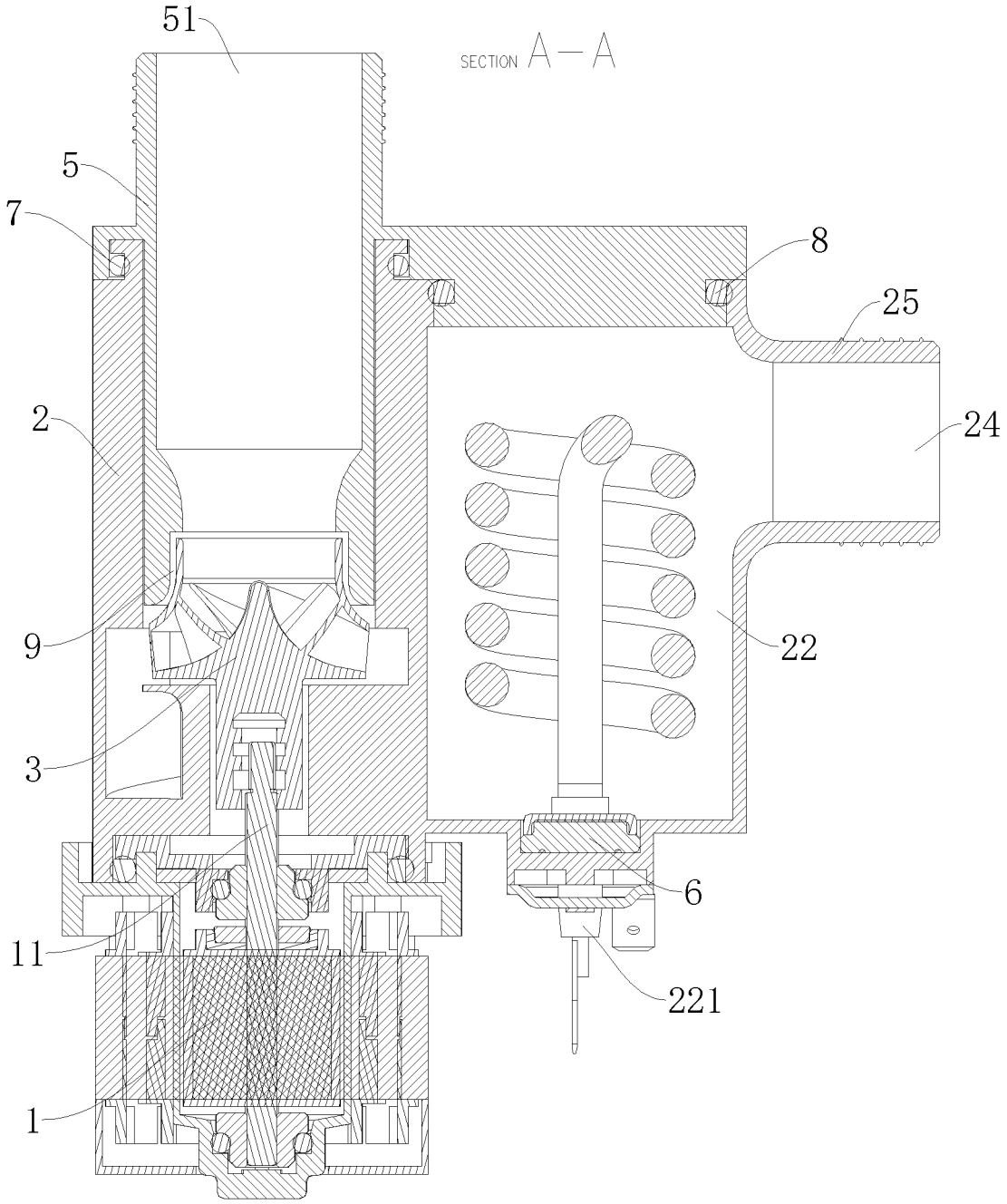
FIG. 2 is a sectional view along line A-A in FIG. 1.

Referring to FIG. 2 and in combination with FIG. 1, in some embodiments of the present disclosure, the pump casing 2 includes an outlet connection tube 25 in communication with the heating cavity 22, and a free end of the outlet connection tube 25 forms the water outlet 24. For example, the pump casing 2 may be provided with the outlet connection tube 25, the outlet connection tube 25 may be in communication with the heating cavity 22, and the free end of the outlet connection tube 25 may form the water outlet 24. Thus, it is convenient to couple external pipes to the outlet connection tube 25, so that the water heated by the heating member 4 can flow out through the outlet connection tube 25 and the water outlet 24.

Figure 3:
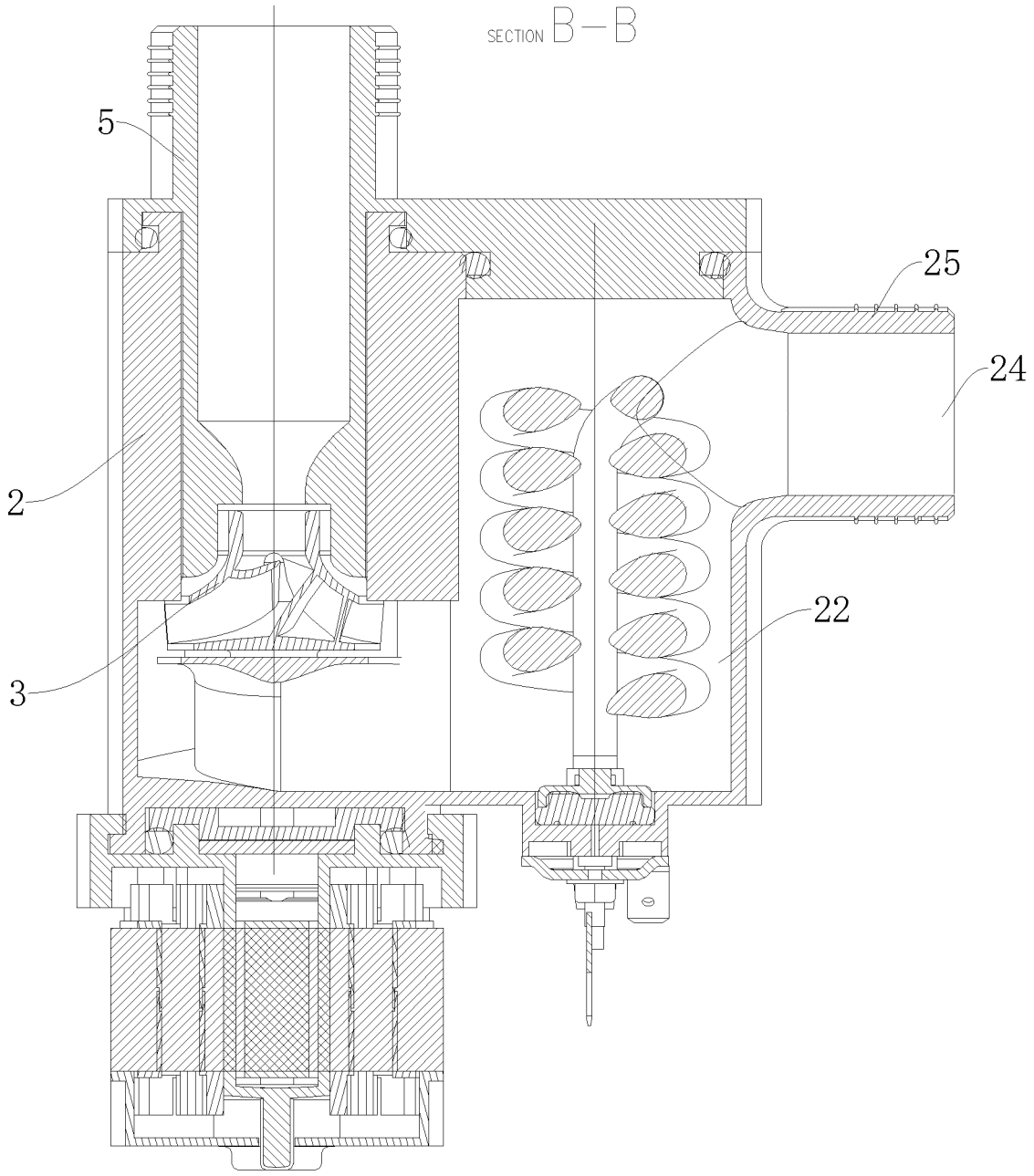
FIG. 3 is a sectional view along line B-B in FIG. 1.
Figure 5:
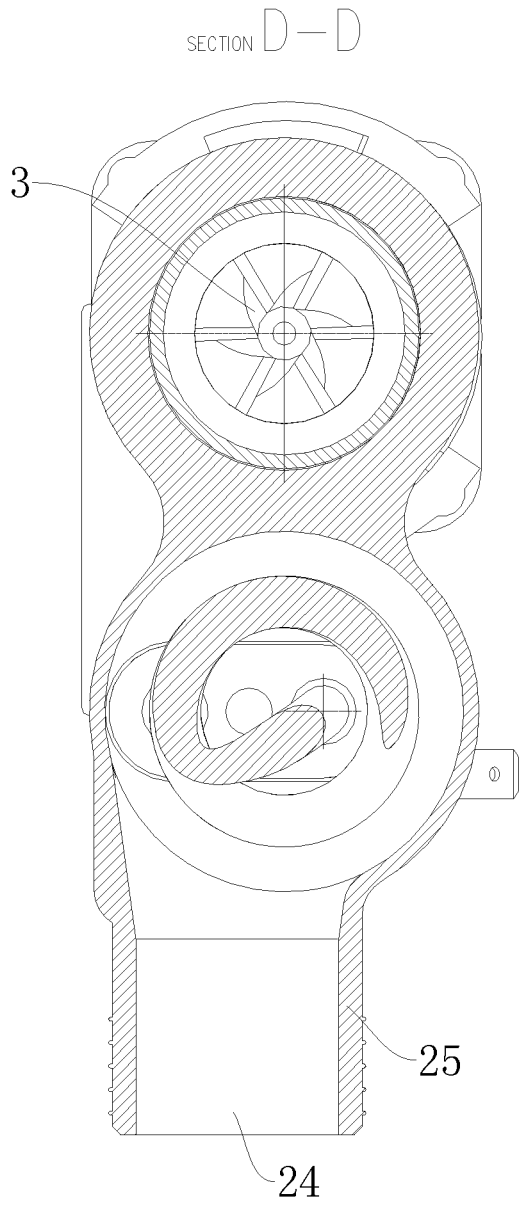
FIG. 5 is a sectional view along line D-D in FIG. 1.

Further, with reference to FIGS. 3 and 5, the outlet connection tube 25 is constructed to extend tangentially along an outer side wall of the heating cavity 22. For example, in some embodiments of the present disclosure, the outlet connection tube 25 may be constructed to extend tangentially along the outer side wall of the heating cavity 22. Thus, by combining the tangential outlet connection tube 25 with the tangential expansion channel, a strong cyclonic flow at an inlet of the heating cavity can be formed, which facilitates better removal of the air bubbles.

For the heating pump 100 according to embodiments of the present disclosure, the tangential outlet connection tube 25 and the tangential expansion channel can form the strong cyclonic flow at the inlet of the heating cavity, avoiding abnormal noise and dry burning caused by the accumulation of air bubbles in the heating cavity 22.

Certainly, the present disclosure is not limited thereto. In some embodiments of the present disclosure, the outlet connection tube 25 may also not extend tangentially along the outer side wall of the heating cavity 22, in which case a certain cyclonic flow can also be formed.

Referring to FIG. 2 and in combination with FIG. 1, according to some embodiments of the present disclosure, the heating cavity 22 include a wiring terminal 221 electrically coupled to the heating member 4, to be coupled to an external power supply circuit. For example, the heating cavity 22 may include the wiring terminal 221, the wiring terminal 221 may be electrically coupled to the heating member 4, and the wiring terminal 221 may be arranged on the outer side wall of the heating cavity 22. With the wiring terminal 221, it is convenient to be coupled to the external power supply circuit, which further facilitates heating of the water flow.

Further, referring to FIGS. 2 and 15, the heating cavity 22 includes a first mounting groove 212 at a bottom of the heating cavity, and a first seal member 6 is arranged in the first mounting groove 212. For example, the bottom of the heating cavity 22 may be formed with the first mounting groove 212, and the first seal member 6 may be arranged in the first mounting groove 212 and may be, for example, a seal ring or a seal gasket. Thus, by providing the first seal member 6 in the first mounting groove 212, sealed connection of the heating cavity 22 can be achieved, preventing water leakage of the heating cavity 22.

Referring to FIGS. 1 and 2, according to some embodiments of the present disclosure, the heating member 4 is a heating tube extending spirally, and a spiral direction of the heating tube is constructed to be consistent with the water flow direction. For example, in some embodiments of the present disclosure, the heating member 4 may be a heating tube, the heating tube may extend spirally, and the spiral direction of the heating tube is constructed to coincide with the water flow direction. As a result, the water flow entering the heating cavity 22 can move along the wall surface of the heating cavity 22, and a cyclonic flow can be formed, which can prevent accumulation of the air bubbles in the heating cavity 22, and can also avoid the abnormal noise and the dry burning phenomenon due to the accumulation of the air bubbles in the heating cavity 22, thereby prolonging the service life of the heating tube.

For example, in some embodiments of the present disclosure, the heating tube fitted within the heating cavity 22 may be designed to be consistent with a spiral direction of the water (e.g., the water flow direction). For example, the heating tube may swirl clockwise as viewed from a drive motor side.

For the heating pump 100 according to embodiments of the present disclosure, the pump cavity 21 (e.g., the water pump volute 212) and the heating cavity 22 may be in communication with each other through the communication channel 23, such as the expansion channel, so that the water flowing into the heating cavity 22 through the expansion channel will move along the wall surface of the heating cavity 22, and the cyclonic flow can be formed, which can prevent accumulation of the air bubbles in the heating cavity 22, and can also avoid the abnormal noise and the dry burning phenomenon due to the accumulation of the air bubbles in the heating cavity 22, thereby prolonging the service life of the heating tube.

Certainly, the present disclosure is not limited thereto. In some embodiments of the present disclosure, the heating member 4 can also adopt a different structural form from the heating tube. In some embodiments of the present disclosure, the heating member 4 may be a thick film (not shown in the drawings) on an inner wall surface of the heating cavity 22. For example, the heating member 4 may be a thick film, and the thick film may be arranged on the inner wall surface of the heating cavity 22. Thus, heating of the water flowing into the heating cavity 22 can also be achieved by the thick film.

According to some embodiments of the present disclosure, a flow guide rib is arranged on the inner wall surface of the heating cavity 22, and the flow guide rib is constructed to extend in a direction consistent with the water flow direction. For example, the flow guide rib is arranged on the inner wall surface of the heating cavity 22, and an extension direction of the flow guide rib may be constructed to be consistent with the water flow direction. Thus, by arranging the flow guide rib on the inner wall surface of the heating cavity 22, a swirling effect of the water flow can be enhanced.

For example, the flow guide rib may be an integral structure extending spirally, or there may be a plurality of flow guide rib separately arranged, and the extension manner of the plurality of flow guide ribs may be consistent with the water flow direction.

According to some embodiments of the present disclosure, the motor shaft 11 is formed with an external thread and the impeller 3 is formed with an internal thread, the external thread matches the internal thread to realize threaded connection between the motor shaft 11 and the impeller 3. The external thread and the internal thread may spiral in a common direction, and the spiral direction of the external thread/the internal thread is opposite to a rotation direction of the drive motor 1. Thus, the assembly and connection between the drive motor 1 and the impeller 3 can be achieved by matching the external thread with the internal thread, and the reliability of the assembly between the drive motor 1 and the impeller 3 can be further ensured by making the spiral direction of the external thread/the internal thread opposite to the rotation direction of the drive motor 1.

Referring to FIG. 2, in some embodiments of the present disclosure, the heating pump 100 may further include an end cap 5, with the water inlet 51 formed in the end cap 5, and the end cap 5 is hermetically coupled to the pump casing 2. For example, in some embodiments of the present disclosure, the end cap 5 may be formed with the water inlet 51 in communication with the pump cavity 21, and the end cap 5 is hermetically coupled to the pump casing 2. Thus, the sealing performance between the end cap 5 and the pump casing 2 can be ensured, which can prevent water leakage and improve the performance of the heating pump 100.

Figure 6:
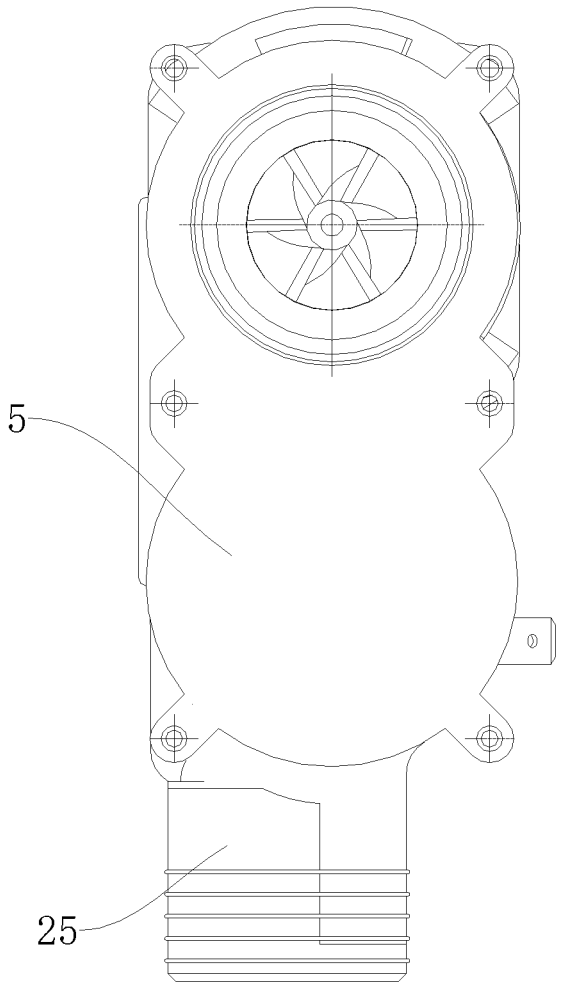
FIG. 6 is another schematic view of the heating pump in FIG. 1 according to embodiments of the present disclosure.

According to some embodiments of the present disclosure, referring to FIG. 6, the end cap 5 is detachably coupled to the pump casing 2. Thus, by making the end cap 5 detachably coupled to the pump casing 2, the assembly and disassembly between the end cap 5 and the pump casing 2 can be achieved conveniently, and the maintenance of the heating pump 100 can be facilitated.

For example, in some embodiments of the present disclosure, the end cap 5 and the pump casing 2 may be coupled by, for example, screw connection. However, the present disclosure is not limited thereto; in some embodiments of the present disclosure, the end cap 5 and the pump casing 2 may also be coupled by snap connection.

Figure 20:
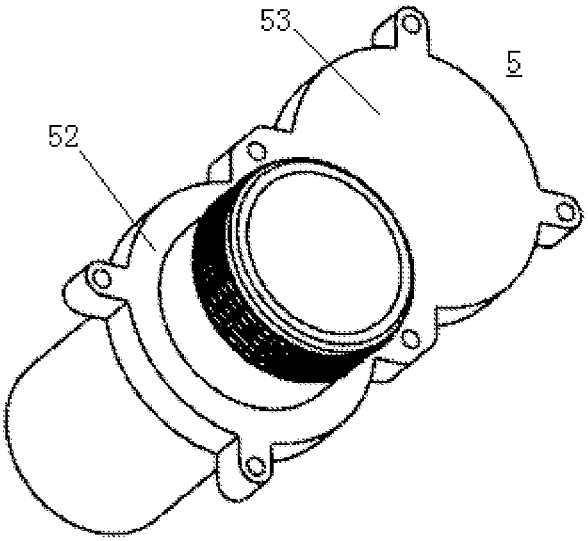
FIG. 20 is a perspective view of an end cap of the heating pump in FIG. 1 according to embodiments of the present disclosure.
Figure 21:
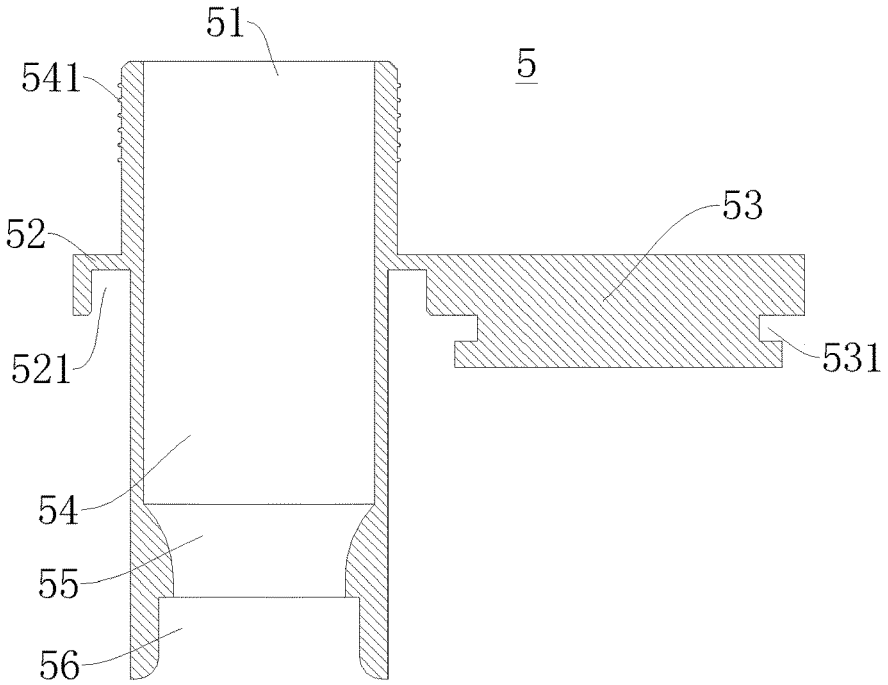
FIG. 21 is a sectional view of the end cap of the heating pump in FIG. 20 according to embodiments of the present disclosure.

Further, referring to FIG. 20 and FIG. 21, the end cap 5 may include a water inlet end cap 52 and a water outlet end cap 53.

Specifically, referring to FIG. 2, a second seal member 7 may be arranged between the water inlet end cap 52 and the pump casing 2, and a third seal member 8 may be arranged between the water outlet end cap 53 and the pump casing 2. For example, without limitation, the second seal member 7 and the third seal member 8 may be, for example, O-rings or the like.

Referring to FIGS. 20 and 21, the water inlet end cap 52 may be formed with a mating slot 521, the pump casing 2 is formed with a mating portion 26 (refer to FIG. 15), and the mating portion 26 is fitted in the mating slot 521. The mating portion 26 may be formed with a second mounting groove 261, and the second mounting groove 261 is suitable for mounting the second seal member 7. The water outlet end cap 53 may be formed with a third mounting groove 531, and the third mounting groove 531 is suitable for mounting the third seal member 8. Thus, by mounting the second seal member 7 in the second mounting groove 261, the sealing connection between the water inlet end cap 52 and the pump casing 2 can be facilitated, and by mounting the third seal member 8 in the third mounting groove 531, the sealing connection between the water outlet end cap 53 and the pump casing 2 can be facilitated, preventing water leakage and ensuring the operational reliability of the heating pump 100.

Referring to FIG. 21 and in combination with FIG. 2, in some embodiments of the present disclosure, in the water flow direction, a water inlet channel 54, a rectification channel 55, and a mating channel 56 are defined at an inner side of the end cap 5 (e.g., the water inlet end cap 52), and a water inlet end of the water inlet channel 54 forms the water inlet 51. The impeller 3 is arranged at the mating channel 56 and is spaced apart from an inner wall surface of the mating channel 56 to define a return channel 9 for return water flow between the impeller 3 and the mating channel 56.

For example, in the water flow direction, the water inlet channel 54, the rectification channel 55, and the mating channel 56 are defined at the inner side of the end cap 5, and the water inlet end of the water inlet channel 54 forms the water inlet 51. The rectification channel 55 is used to dock with the impeller 3. The impeller 3 may be arranged at the mating channel 56 and spaced apart from the inner wall surface of the mating channel 56, such that the return channel 9 for return water flow can be defined between the impeller 3 and the mating channel 56.

For the heating pump 100 according to embodiments of the present disclosure, there may be water backflow due to the processing technique, so a main function of the mating channel 56 is to cooperate with the impeller 3 to form a narrow return channel 9, which can suppress the backflow and improve the efficiency of the heating pump 100.

Further, in combination with FIG. 21, a sealing protrusion 541 is formed on an outer wall surface of the water inlet channel 54 to connect a water inlet hose. For example, the outer wall surface of the water inlet channel 54 may be formed with the sealing protrusion 541, and the sealing protrusion 541 may be annular. There may be a plurality of sealing protrusions 541 spaced apart along an extension direction of the water inlet channel 54 to facilitate connection with the water inlet hose by the sealing protrusions 541.

In some embodiments of the present disclosure, referring to FIG. 2, corresponding sealing protrusions may be formed on an outer wall surface of the water outlet connection tube 25, to facilitate connection with a water outlet hose by the sealing protrusions.

Referring to FIG. 21 and in combination with FIG. 2, in some embodiments of the present disclosure, in the water flow direction, an inner wall surface of the rectification channel 55 is constructed in a shape with a gradually reduced radial dimension. For example, in some embodiments of the present disclosure, in the water flow direction, the inner wall surface of the rectification channel 55 is constructed with the gradually reduced radial dimension. As a result, the rectification channel 55 is beneficial to rectification and stabilizes the water flow.

Further, the inner wall surface of the rectification channel 55 is constructed as a tapered or arc shape. For example, in some embodiments of the present disclosure shown in FIG. 21, the inner wall surface of the rectification channel 55 may be constructed in the arc shape. Certainly, the present disclosure is not limited thereto, and in some embodiments of the present disclosure, the inner wall surface of the rectification channel 55 may also be constructed in the tapered shape.

In some embodiments of the present disclosure, the end cap 5 is of an integral structure or a split structure. For example, in some embodiments of the present disclosure, the end cap 5 may have an integral structure. Certainly, in some embodiments of the present disclosure, the end cap 5 may also have a split structure. The present disclosure does not limit the specific forming manner of the end cap 5, which can be set according to the needs in practical applications.

Specific embodiments of the heating pump 100 according to the present disclosure will be described below with reference to the accompanying drawings.

Figure 7:
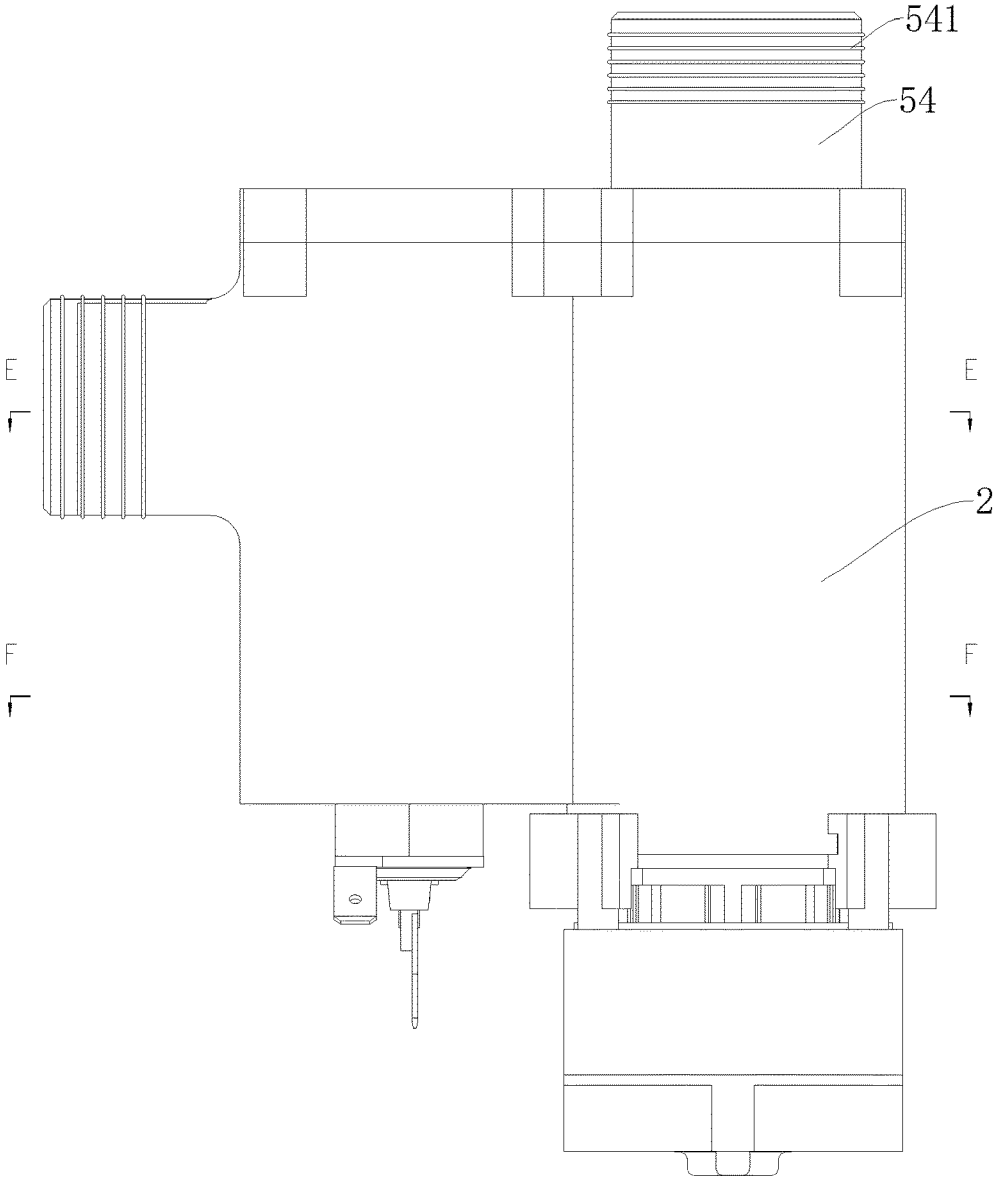
FIG. 7 is a further schematic view of the heating pump in FIG. 1 according to embodiments of the present disclosure.
Figure 8:
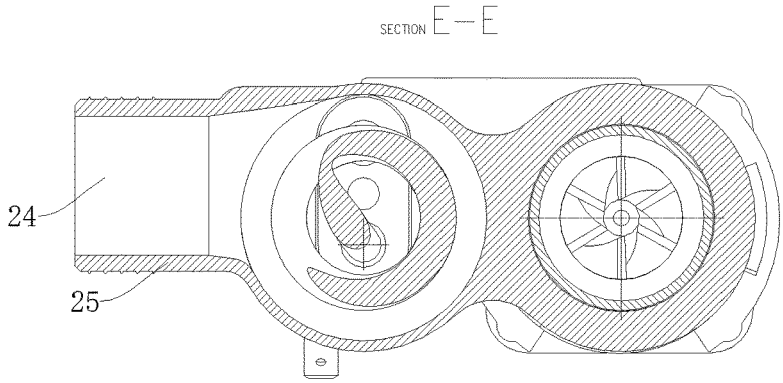
FIG. 8 is a sectional view along line E-E in FIG. 7.
Figure 10:
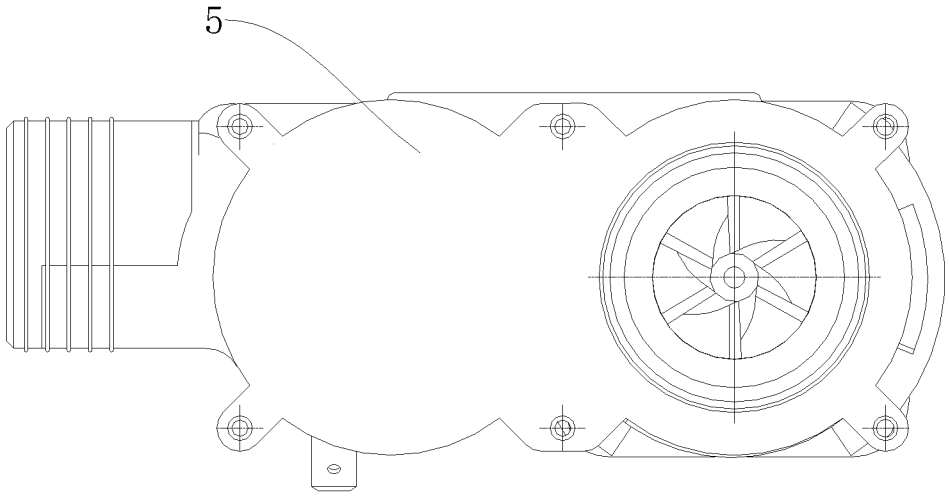
FIG. 10 is still another schematic view of the heating pump in FIG. 1 according to embodiments of the present disclosure.

The structure of the heating pump 100 according to embodiments of the present disclosure is as shown in FIGS. 1-10, in which FIG. 1 is a schematic view of the heating pump 100 according to embodiments of the present disclosure; FIG. 2 is a sectional view along line A-A in FIG. 1; FIG. 3 is a sectional view along line B-B in FIG. 1; FIG. 4 is a sectional view along line C-C in FIG. 1; FIG. 5 is a sectional view along line D-D in FIG. 1; FIG. 6 is another schematic view of the heating pump 100 in FIG. 1 according to embodiments of the present disclosure; FIG. 7 is a further schematic view of the heating pump 100 in FIG. 1 according to embodiments of the present disclosure; FIG. 8 is a sectional view along line E-E in FIG. 7; FIG. 9 is a sectional view along line F-F in FIG. 7; FIG. 10 is still another schematic view of the heating pump 100 in FIG. 1 according to embodiments of the present disclosure.

The heating pump 100 includes: a drive motor 1, a pump casing 2, an impeller 3, a wiring terminal 221, a heating member 4 (e.g., a heating tube or a thick film), a first seal member 6, a second seal member 7 (e.g., an O-ring), a third seal member 8 (e.g., an O-ring), an end cap 5 and other components. The drive motor 1 and the impeller 3 may be coupled by an inner thread of the impeller 3 and an outer thread of the motor shaft 11, in which a spiral direction of the inner thread may be consistent with a spiral direction of the outer thread, and the spiral direction of the inner thread/the outer thread is opposite to a rotation direction of the drive motor 1 to ensure that the impeller 3 is driven by the drive motor 1 instead of falling off. The pump casing 2 has a two-cavity structure, and a pump cavity 21 and a heating cavity 22 may be defined in the pump casing 2. A water pump volute 212 and the heating cavity are coupled by a communication channel 23 (such as an expansion channel) between the pump cavity 21 and the heating cavity 22. A lower end of the pump casing 2 and the wiring terminal 221 of the heating tube may be coupled by bolts, and the heating cavity 22 is formed with a first mounting groove 212 (e.g., a concave structure) to mount the first seal member 6 (e.g., a seal gasket) to prevent water leakage. The end cap 5 and the pump casing 2 may be coupled by screws, and the second seal member 7 and the third seal member 8 may be arranged between the end cap 5 and the pump casing 2 to prevent water leakage from the end cap 5. For example, the second seal member 7 may be arranged between a water inlet end cap 52 and the pump casing 2, and the third seal member 8 may be arranged between a water outlet end cap 53 and the pump casing 2.

The water enters the heating pump 100 through a water inlet channel 54 (e.g., a water suction connection tube) of the end cap 5 with a sealing protrusion 541 on an outer side, and subsequently enters the impeller 3 through a rectification channel 55. The arrangement of the rectification channel 55 facilitates rectification. After the work and pressurization of the impeller 3, a high-speed water flow enters the water pump volute 212 for collection, and then enters the heating cavity 22 through a tangential communication channel 23 (e.g., an expansion channel). Since the water enters the heating cavity 22 in a tangential way, the main water flow will swirl along the wall surface, bypass, at a high velocity, the heating tube with the same rotation direction as a swirling direction of the water flow, and finally be guided out of the heating pump 100 through a tangential outlet connection tube 25 after one round of rotation and being heated.

Figure 11:
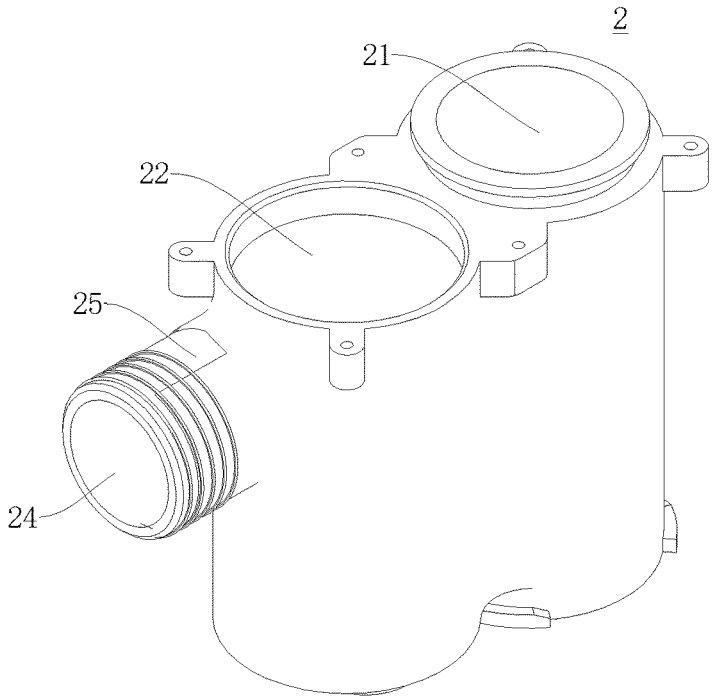
FIG. 11 is a perspective view of a pump casing of the heating pump in FIG. 1 according to embodiments of the present disclosure.
Figure 12:
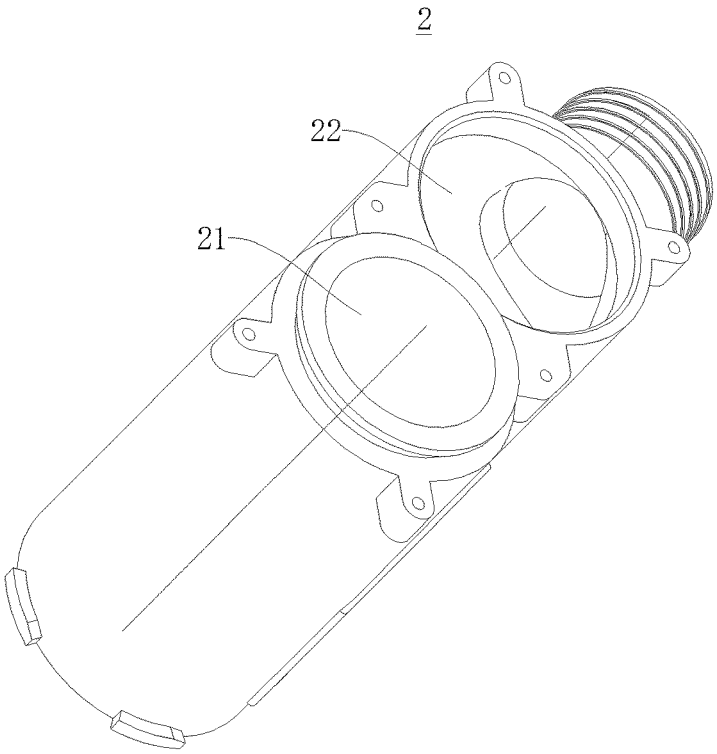
FIG. 12 is another perspective view of a pump casing of the heating pump in FIG. 1 according to embodiments of the present disclosure.
Figure 13:
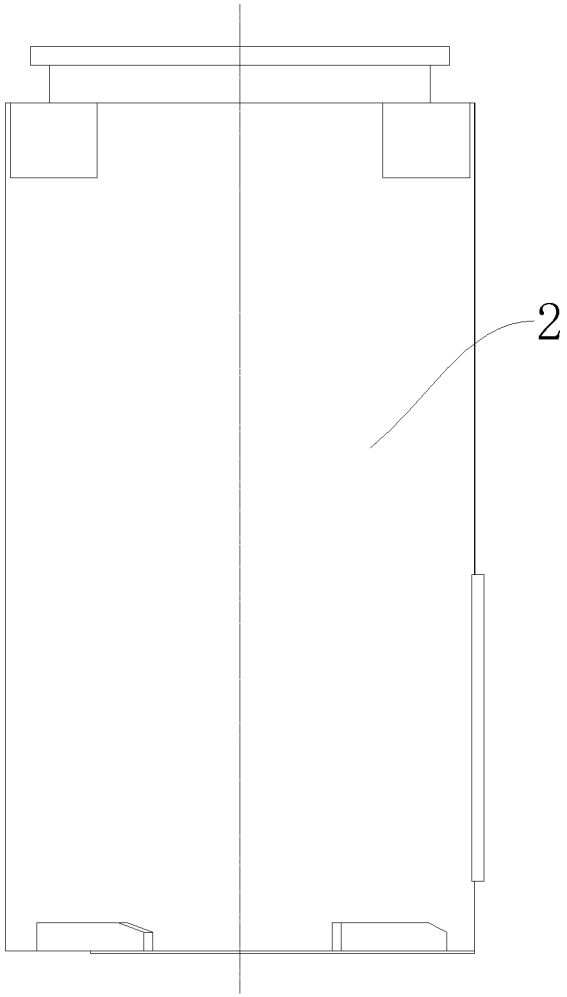
FIG. 13 is a schematic view of a pump casing of the heating pump in FIG. 1 according to embodiments of the present disclosure.
Figure 17:
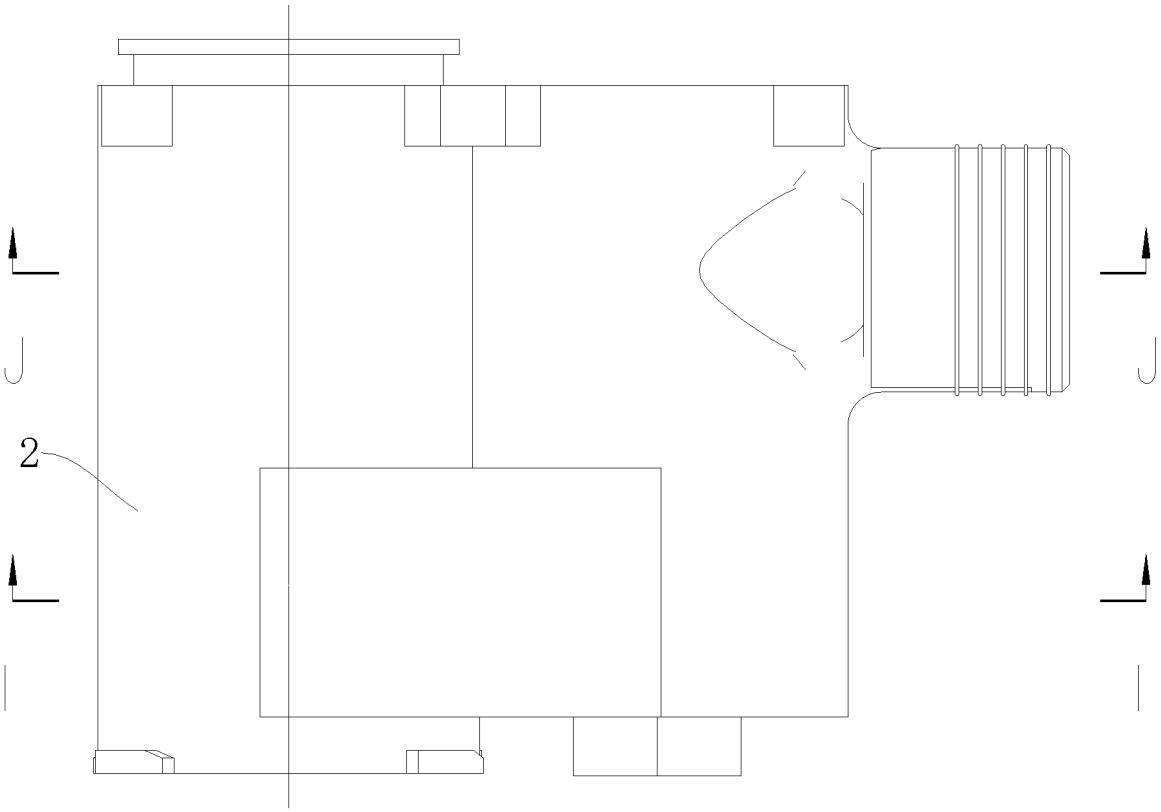
FIG. 17 is a further schematic view of a pump casing of the heating pump in FIG. 1 according to embodiments of the present disclosure.
Figure 19:
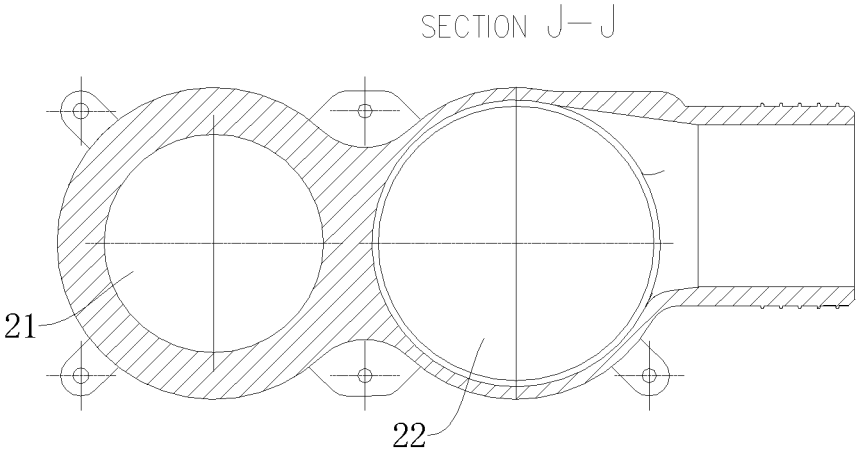
FIG. 19 is a sectional view along line J-J in FIG. 17.

The structure of the pump casing 2 is detailed in FIGS. 11-17, in which FIG. 11 is a perspective view of the pump casing 2 of the heating pump 100 in FIG. 1 according to embodiments of the present disclosure; FIG. 12 is another perspective view of the pump casing 2 of the heating pump 100 in FIG. 1 according to embodiments of the present disclosure; FIG. 13 is a schematic view of the pump casing 2 of the heating pump 100 in FIG. 1 according to embodiments of the present disclosure; FIG. 14 is another schematic view of the pump casing 2 of the heating pump 100 in FIG. 1 according to embodiments of the present disclosure; FIG. 15 is a sectional view along line G-G in FIG. 14; FIG. 16 is a sectional view along line H-H in FIG. 14; FIG. 17 is a further schematic view of the pump casing 2 of the heating pump 100 in FIG. 1 according to embodiments of the present disclosure; FIG. 18 is a sectional view along line I-I in FIG. 17; FIG. 19 is a sectional view along line J-J in FIG. 17.

The pump casing 2 mainly includes: an inlet connection section 211, a water pump volute 212, a communication channel 23 (e.g., an expansion channel), a heating cavity 22, an outlet connection tube 25, and a first mounting groove 212. The inlet connection section 211 is fitted over an inlet connection tube, which is usually a straight tube. The communication channel 23 (e.g., the expansion channel) functions to couple the water pump volute 212 to the heating cavity 22 and is structurally arranged in a tangential position (near the top) of the heating pump 100. The main consideration of this design is to facilitate the smooth introduction of the air bubbles drawn in by the impeller 3 into the heating cavity 22 without accumulating in the water pump volute 212 to avoid noise of the air bubbles. Another consideration for the arrangement that the communication channel 23 (e.g., the expansion channel) leads to the heating cavity 22 tangentially is to introduce the water into the heating cavity 22 at high speed and make the water swirl along the wall surface of the heating cavity 22, to improve the heat transfer performance of the heating tube. The structure of the communication channel 23 (e.g., the expansion channel) is expansive, gradually increasing from an upstream side to a downstream side in the water flow direction, which usually is associated with an expansion degree of no greater than 20° to avoid losses due to expansion that is too great. The arrangement of the heating cavity 22 is featured in that the heating cavity 22 is basically arranged side by side with the pump cavity 22 in an axial direction (the impeller 3 is arranged in the pump cavity 22), and the bottom of the heating cavity 22 is formed with a first mounting groove 212 that is used to mount the first seal member 6 such as a seal gasket, so that the heating member 4 (e.g., the heating tube) and wiring terminal 221 can be sealed inside and outside. The heating tube is arranged within the heating cavity 22, and since the high temperature of the heating tube only radiates the heating cavity 22 without affecting the impeller 3, there will be no premature aging of the plastic impeller 3 due to the thermal radiation of the heating tube, which may otherwise affect the performance of the heating pump 100. Since the communication channel 23 (e.g., the expansion channel) leads to the heating cavity 22 from the top, the design of the heating tube is usually in line with the swirling direction of the water flow, i.e., the heating tube is wound clockwise when viewed from the drive motor side. Finally, the water flow after one round of rotation is guided out of the heating pump 100 through the tangential outlet connection tube 25, and the outlet connection tube 25 is preferably arranged at the top of the heating cavity 22. The main purpose is to smoothly discharge the air bubbles in the heating cavity 22 to avoid the noise of the air bubbles, and the presence of the air bubbles may also affect the heat transfer of the heating tube, which will seriously cause damage due to the dry burning phenomenon.

The structure of the end cap 5 is shown in FIGS. 20-21, in which FIG. 20 is a perspective view of the end cap 5 of the heating pump 100 in FIG. 1 according to embodiments of the present disclosure; FIG. 21 is a sectional view of the end cap 5 of the heating pump 100 in FIG. 20 according to embodiments of the present disclosure. The end cap 5 mainly functions to couple a water inlet pipe and seal the heating cavity 22. The end cap 5 may have an integral structure or may be divided into two end caps, namely, a water inlet end cap 52 and a water outlet end cap 53. The end cap 5 mainly includes: a water inlet channel 54, a rectification channel 55, a mating channel 56, the water inlet end cap 52 and a mating slot 521 in the water inlet end cap 52, and the water outlet end cap 53 and a third mounting groove 531 in the water outlet end cap 53.

The water inlet channel 54 has a sealing protrusion 541 at an outer side for connection with the water inlet hose, and the rectification channel 55 is a contraction section and mainly functions to stabilize the water flow and dock with the impeller 3. The mating channel 56 mainly forms the return channel 9 with an outer side of the impeller 3. Since such small heating pumps usually has a certain backflow of water due to the processing technique, the main function of the mating channel 56 is to match with the impeller 3 to form a narrow return channel 9, to suppress the backflow and improve the efficiency of the heating pump 100. The water outlet end cap 53 mainly serves to seal the water flow on a side of the heating tube, and the third mounting groove 531 is machined inside the end cap to seal the heating cavity 22 in cooperation with the third seal member 8 such as an O-ring.

The heating pump 100 according to embodiments of the present disclosure can be used in a variety of devices for heating liquid, such as dishwashers, washing machines, dryers, and washing-drying machines. A medium passing through the heating pump 100 may be water or a liquid with foam. Those skilled in the art should know that the application scenarios of the heating pump 100 according to embodiments of the present disclosure do not limit the structure of the heating pump 100. Depending on the practical application requirements, the outlet and inlet of the heating pump 100 may be coupled to pipes outside the heating pump 100.

It should be noted that a longitudinal section of an object referred to in embodiments of the present disclosure refers to a section parallel to a symmetry axis of the object, and a cross section refers to a section perpendicular to the symmetry axis.

Figure 22:
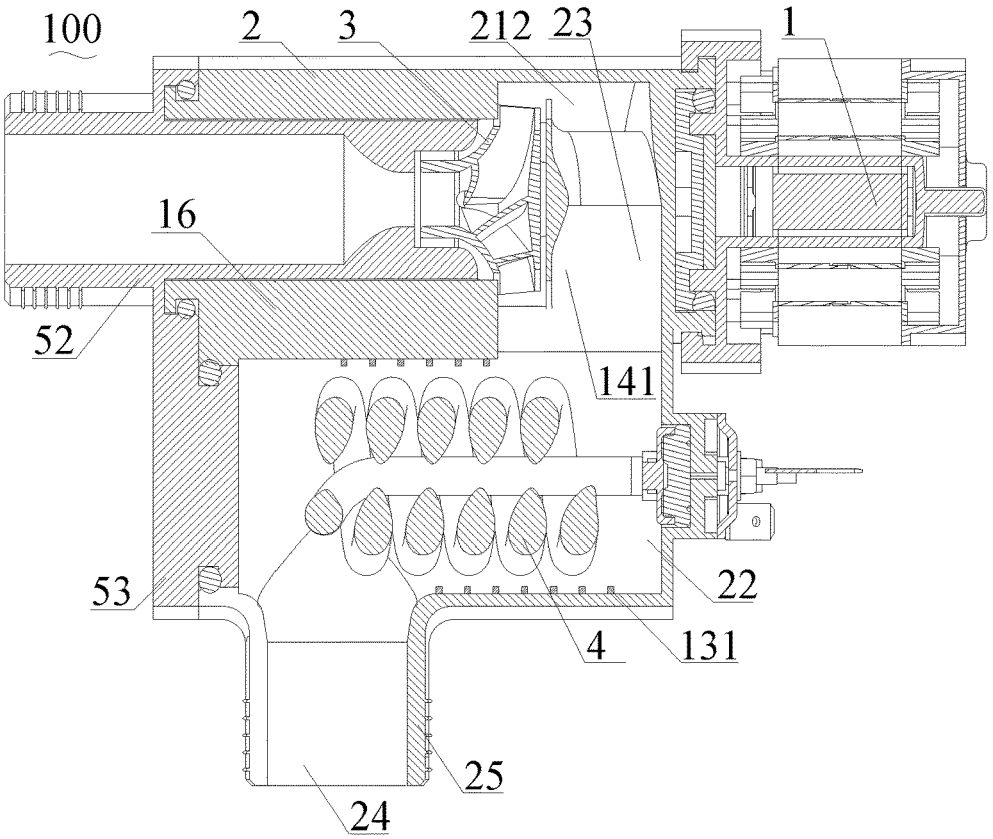
FIG. 22 is a longitudinal section view of a heating pump according to embodiments of the present disclosure.

As shown in FIG. 22, the heating pump 100 includes a pump casing 2, an impeller 3 and a heating member 4. The pump casing 2 internally forms a pump cavity 21, a water pump volute 212 of the pump cavity (e.g., a liquid collection cavity), and a heating cavity 22. A liquid inlet of the impeller 3 is in communication with the pump cavity 21, and a liquid outlet of the impeller 3 is in communication with the water pump volute 212 of the pump cavity. The water pump volute 212 of the pump cavity is in communication with the heating cavity 22 by a communication channel 23. The heating member 4 is arranged within the heating cavity 22. The heating cavity 22 includes an outlet connection tube 25 that defines an outlet channel, and a free end of the outlet connection tube 25 forms a water outlet 24. A fluid enters the impeller 3 through the pump cavity 21, and after centrifugal pressurization of the impeller 3, the fluid flows into the water pump volute 212 of the pump cavity through the outlet of the impeller 3. The fluid in the water pump volute 212 of the pump cavity flows into the heating cavity 22 through the communication channel 23, and flows into the water outlet 24 after being heated by the heating member 4 in the heating cavity 22.

The impeller 3 is arranged between the pump cavity 21 and the water pump volute 212 of the pump cavity, and the heating member 4 is arranged in the heating cavity 22. By arranging the impeller 3 and the heating member 4 in different cavities, there is no need for a cavity of a larger size to accommodate the impeller 3 and the heating member 4 in the pump casing 2, and the cavities where the impeller 3 and the heating member 4 are both located are isolated by the communication channel 23, preventing the high temperature of the heating member 4 from radiating the impeller 3 and avoiding premature aging of the impeller 3.

In some embodiments of the present disclosure, as shown in FIG. 22, the impeller 3 is coupled to a drive device and is driven by the drive device to rotate, working on the fluid flowing through the impeller 3 by centrifugal pressurization, and increasing the speed of the fluid. The drive device may be fixed to the pump casing 2, and the drive device may be, for example, a drive motor 1. The drive motor 1 and the impeller 3 can be coupled to an end of an output shaft (e.g., a motor shaft 11) of the drive motor 1 through internal threads of the impeller 3, and a rotation direction of the impeller 3 is opposite to a rotation direction of the drive motor 1 to ensure that the impeller 3 does not fall off during operation. The shape, number and spacing of blades of the impeller 3 can be designed according to actual needs.

Figure 23:
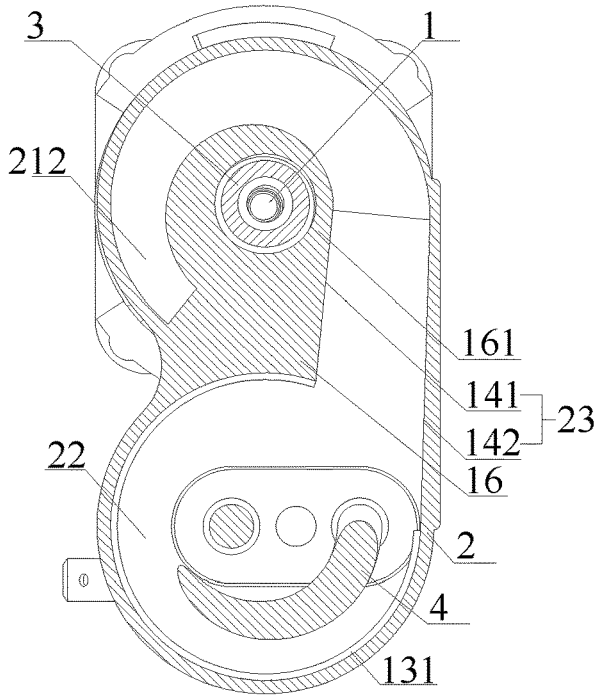
FIG. 23 is a cross section view of a heating pump according to embodiments of the present disclosure.

In some embodiments, as shown in FIG. 23, an axis of the communication channel 23 is perpendicular to an axis of the heating cavity 22, and the axis of the communication channel 23 is not in a common plane with the axis of the heating cavity 22; and the heating cavity 22 is similarly cylindrical. When the fluid enters the heating cavity 22 through the communication channel 23, dynamic pressure of the fluid is converted into a force in two directions. In a normal direction of a wall of the heating cavity 22, the dynamic pressure of the fluid is converted into a static pressure on the wall of the heating cavity 22; in a tangential direction of the wall of the heating cavity 22, the dynamic pressure of the fluid is converted into a driving force, which drives the fluid to rotate and flow along the wall of the heating cavity 22, thereby forming a cyclonic flow around the heating member 4, avoiding phenomena of uneven heating and dry burning, and improving the heating efficiency and the service life of the heating member 4.

In some embodiments, as shown in FIG. 23, a cross-sectional area of the communication channel 23 increases along a direction from the water pump volute 212 of the pump cavity to the heating cavity 22. On the premise that the flow rate of the fluid remains unchanged, the cross-sectional area is inversely proportional to the flow rate of the fluid. By increasing the cross-sectional area of the communication channel 23 from the water pump volute 212 of the pump cavity to the heating cavity 22, the flow rate of the fluid when flowing into the heating cavity 22 is reduced, and the dynamic pressure of the fluid is recovered, which in turn increases the head of the heating pump 100. Meanwhile, the reduction of the flow velocity of the fluid when flowing into the heating cavity 22 can also reduce the loss of kinetic energy of the fluid and further enhance the swirling effect of the water flow, thereby achieving uniform heating of the fluid and avoiding dry burning.

In some embodiments, the cross-sectional area of the communication channel 23 increases continuously and uniformly along the direction from the water pump volute 212 of the pump cavity to the heating cavity 22 to avoid the loss of kinetic energy of the fluid due to a sudden change of the section and further enhance the swirling effect of the water flow, to achieve uniform heating of the fluid and avoid dry burning.

In some embodiments, as shown in FIG. 23, the longitudinal section of the communication channel 23 exhibits an axisymmetric shape to facilitate the processing of the communication channel 23. Meanwhile, an increase in the cross-sectional area of the communication channel 23 along the direction from the water pump volute 212 of the pump cavity to the heating cavity 22 is less than a certain threshold. Specifically, an angle between two sides of the longitudinal section of the communication channel 23 is less than a preset value that may be, for example 20°, which can ensure that the increase in the cross-sectional area of the communication channel 23 along the direction from the water pump volute 212 of the pump cavity to the heating cavity 22 is less than a certain threshold, and ensure that the fluid flows into the heating cavity 22 at a flow velocity greater than a certain threshold and hence the fluid does not separate from the wall of the heating cavity 22, further enhancing the swirling effect of the fluid, achieving uniform heating of the fluid and avoiding dry burning.

In some embodiments, within the cross section of the communication channel 23, an outer wall surface 142 is tangential to the wall of the heating cavity 22. Under the action of centrifugal force, the fluid flows along the outer wall surface 142 of the communication channel 23 when it flows into the heating cavity 22 from the water pump volute 212 of the pump cavity, and flows into the heating cavity 22 in a tangential direction, and all the dynamic pressure of the fluid is converted into a driving force that drives the fluid to rotate and flow along the wall of the heating cavity 22, further enhancing the swirling effect of the water flow, achieving uniform heating of the fluid and avoiding dry burning.

In some embodiments, as shown in FIG. 23, the pump casing 2 has an inner wall surface 141 and the outer wall surface 142 that form the communication channel 23. The inner wall surface 141 and the outer wall surface 142 are surfaces in contact with the fluid in the communication channel 23 instead of surfaces in contact with the external environment. A wall farther from the axis of the pump cavity 21 is the outer wall surface 142, and another wall closer to the axis of the pump cavity 21 is the inner wall surface 141. The inner wall surface 141 and the outer wall surface 142 correspond to two sides of the section in the longitudinal section of the communication channel 23. The inner wall surface 141 and/or the outer wall surface 142 have/has flat wall surfaces, i.e., there is no protrusion or groove on inner surfaces of the inner wall surface 141 and/or the outer wall surface 142 in contact with the fluid. In some embodiments, the inner surface of the outer wall surface 142 is perpendicular to an axis of the impeller 3. A flow direction of the fluid flowing from the water pump volute 212 of the pump cavity to the communication channel 23 is consistent with a direction of the wall surface of the outer wall surface 142. When the wall surface is flat, the probability of fluid separation is reduced and the flow direction remains unchanged.

When the fluid flows into the heating cavity 22 from the water pump volute 212 of the pump cavity through the communication channel 23 formed by the inner wall surface 141 and the outer wall surface 142, the kinetic energy of the fluid loses along a stroke. Specifically, the loss along the stroke of the fluid means that the kinetic energy of the fluid is converted into internal energy of the inner wall surface 141 and the outer wall surface 142 due to friction between the fluid and the inner wall surface 141 and the outer wall surface 142, and the loss of the kinetic energy of the fluid occurs. The inner wall surface 141 and the outer wall surface 142 are straight lines in the cross section, so that the fluid flows into the heating cavity 22 from the water pump volute 212 of the pump cavity along the straight lines, reducing a movement stroke of the fluid when it flows along the inner wall surface 141 and the outer wall surface 142, and reducing the magnitude of the work done by the friction, which in turn decreases the loss of kinetic energy of the fluid along the stroke when the fluid flows into the heating cavity 22 through the communication channel 23.

When the fluid flows from the water pump volute 212 of the pump cavity through the communication channel 23 into the heating cavity 22, the kinetic energy of the fluid is locally lost. Specifically, when there is a sudden change in the section of the communication channel 23 through which the fluid flows, the loss of the kinetic energy of the fluid occurs. The inner wall surface 141 and the outer wall surface 142 do not have any protrusions or grooves on the inner surfaces in contact with the fluid, which avoids the sudden change in the section of the communication channel 23 and hence avoids the local loss of the kinetic energy of the fluid when the fluid flows into the heating cavity 22 through the communication channel 23.

By configuring the inner surfaces of the side walls of the communication channel 23 as flat surfaces, the loss along the stroke and the local loss of the kinetic energy of the fluid when flowing from the communication channel 23 into the heating cavity 22 can be reduced, enhancing the cyclonic flow of the fluid around the heating member 4 in the heating cavity 22, making the heating of the fluid more uniform, and further avoiding the uneven heating and dry burning phenomena.

In some embodiments, as shown in FIG. 23, the pump casing 2 also includes a partition wall 16 separating a whole formed by the pump cavity 21, the impeller 3, and the water pump volute 212 of the pump cavity from the heating cavity 22. The partition wall 16 is arranged to separate the pump cavity 21, which accommodates the impeller 3, and the water pump volute 212 of the pump cavity from the heating cavity 22, which accommodates the heating member 4, to prevent the thermal radiation of the heating member 4 in the heating cavity 22 from acting on the impeller 3, avoid heat aging of the impeller 3 and extend the service life of the impeller 3.

In some embodiments, as shown in FIG. 22, the communication channel 23 is in communication with a top opening of the heating cavity 22, and the top opening is arranged between the partition wall 16 and a first end of the heating cavity 22. That is, the top opening is an opening close to an end of the heating cavity 22, and the inlet of the heating cavity 22 is opposite to the communication channel 23, which can guide the air bubbles generated in the fluid by the rotation of the impeller 3 into the heating cavity 22 and prevent the air bubbles from accumulating in the water pump volute 212 of the pump cavity and causing noise. Moreover, the fluid entering from the end of the heating cavity 22 will move along the wall surface of the heating cavity 22 and thus rotate and flow, avoiding the accumulation of the air bubbles in the heating cavity 22 and avoiding abnormal noise and dry burning.

In some embodiments, as shown in FIG. 23, the partition wall 16 also includes a guide member 161 that directs the liquid from the liquid outlet to the water pump volute 212 of the pump cavity. The guide member 161 forms the inner wall surface 141 of the communication channel 23, i.e., the inner wall surface of the communication channel 23 is coupled to the partition wall 16 as a whole. The integration of the inner wall surface 141 of the partition wall 16 and the communication channel 23 into a whole simplifies the internal structure of the heating pump 100, lowers the manufacturing cost of the heating pump 100, and reduces the volume of the heating pump 100. The liquid flowing out through the outlet of the impeller 3 is blocked and guided by the inner wall surface 141, flows into the water pump volute 212 of the pump cavity, and then flows into the heating cavity 12 through the communication channel 23 formed by the inner wall surface 141 and the outer wall surface 142.

In some embodiments, as shown in FIG. 22, the axis of the pump cavity 21 and the axis of the heating cavity 22 are parallel, i.e., the pump cavity 21 and the heating cavity 22 described above are arranged side by side, facilitating the processing and mounting of the heating pump 100.

In some embodiments, as shown in FIG. 22, the heating member 4 extends from the first end of the heating cavity 22 to a second end opposite to the first end, and the water outlet 24 is arranged at the second end of the heating cavity 22. The fluid enters the heating cavity 22 from the first end of the heating cavity 22 and generates a cyclonic flow in the heating cavity 22; the cyclonic flow is heated around the heating member 4 and flows through the entire heating cavity 22, flows into the water outlet 24 from the second end of the heating cavity 22, and then flows out. The water outlet 24 is arranged at the second end of the heating cavity 22, so that the fluid in the heating cavity 22 is in full contact with the heating member 4, and in cooperation with the tangential communication channel 23, forms a strong cyclonic flow at the inlet of the heating cavity 22, further avoiding the accumulation of air bubbles in the heating cavity 22. It should be noted that the water outlet 24 may also be arranged in other positions of the heating cavity 22 and at a certain distance from the first end through which the fluid enters the heating cavity 22, and not necessarily at the second end of the heating cavity 22.

An axis of the outlet connection tube 25 is perpendicular to the axis of the heating cavity 22, and a wall surface of the outlet connection tube 25 may be tangential to the wall surface of the heating cavity 22. The fluid flows into the water outlet 24 along the tangential direction of the wall surface of the heating cavity 22. The tangential outflow of the fluid from the heating cavity 22 and the tangential inflow of the fluid from the heating cavity 22 cooperate to form the strong cyclonic flow into the inlet of the heating cavity 22, further preventing the air bubbles from accumulating in the heating cavity 22 and from causing abnormal noise, and avoiding the dry burning phenomenon.

In some embodiments, as shown in FIG. 22, in some embodiments, the heating member 4 is a spiral heating tube which extends from the first end of the heating cavity 22 to the opposite second end thereof. The spiral heating tube is wound along a clockwise direction as viewed from the first end of the heating cavity 30 toward the second end thereof. That is, a winding direction of the spiral heating tube is consistent with a rotation direction of the fluid in the heating cavity 22, which can enhance the swirling effect of the water flow and make the fluid more fully in contact with the spiral heating tube, achieving uniform heating of the fluid and avoiding dry burning.

In some embodiments, as shown in FIG. 22, the axis of the outlet connection tube 25 is perpendicular to an extension direction of the heating member 4, which facilitates the formation of a swirling flow of the fluid in the heating cavity 22. The fluid in the heating cavity 22 rotates and flows along the wall surface and around the axis of the heating cavity 22, flows into the water outlet 24 along the wall surface of the heating cavity 22, and then flows out of the heating pump 100.

In some embodiments, as shown in FIG. 22, the heating cavity 22 includes a flow guide rib 131 along a peripheral direction of a wall from the first end to the second end. The heating cavity 22 is similarly cylindrical in shape, and the flow guide rib 131 is arranged along a circumferential direction. Specifically, there may be a plurality of flow guide ribs 131 arranged at intervals in an axial direction of the heating cavity 22, i.e., from the first end to the second end. By the arrangement of the flow guide ribs 131, the fluid in the heating cavity 22 can be guided, and the degree of swirling of the fluid in the heating cavity 22 can be increased. In some embodiments, the flow guide rib 131 may also have a continuous spiral shape, and as viewed from the first end toward the second end of the heating cavity 22, the flow guide rib 131 spirals and extends in the clockwise direction, i.e., a spiral direction of the flow guide rib 131 is consistent with the rotation direction of the fluid in the heating cavity 22, which can further enhance the swirling effect of the water flow, achieving uniform heating of the fluid and avoiding dry burning.

Figure 24:
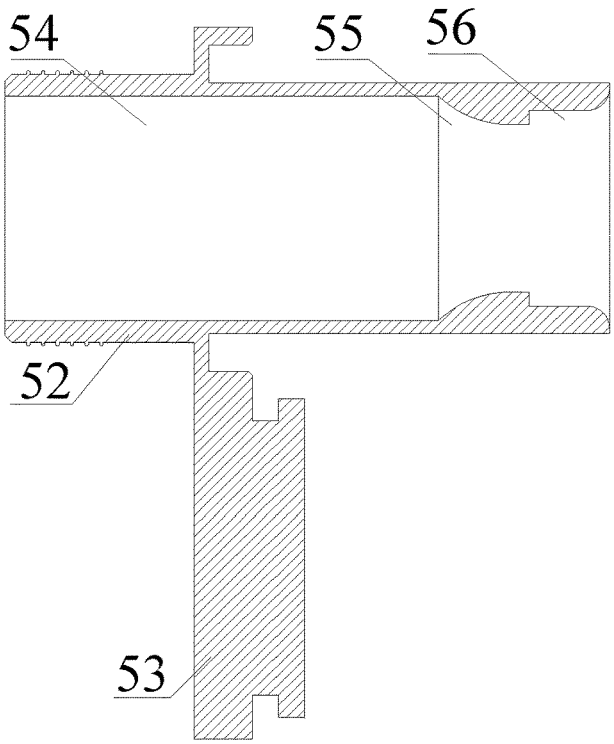
FIG. 24 is a longitudinal section view of an inlet connection tube and an end cap of a heating pump according to embodiments of the present disclosure.

In some embodiments, as shown in FIG. 22 and FIG. 24, the heating pump 100 also includes an end cap 5, and the end cap 5 includes a water inlet end cap 52 and a water outlet end cap 53.

In some embodiments, as shown in FIG. 22, the water inlet end cap 52 is inserted into the pump cavity 21 and fits against the pump casing 2, i.e., there is no gap between an outer wall of the water inlet end cap 52 and an inner wall of the pump cavity 21. Specifically, the water inlet end cap 52 can be fixed to the pump casing 2 by a variety of fixing methods, such as bonding and welding.

In some embodiments, as shown in FIG. 22 and FIG. 24, the water inlet end cap 52 sequentially includes a water inlet channel 54 for introducing fluid, a rectification channel 55 with a reduced cross-sectional area of the channel, and a mating channel 56 forming a gap with the outer side of the impeller 3. The water inlet end cap 52 is used for connection with an external pipe outside the heating pump 100. The fluid flows from the external pipe into the water inlet channel 54 of the inlet connection section 211 and flows into the rectification channel 55 along the water inlet channel 54. In the rectification channel 55, the fluid is rectified, the turbulence is reduced, and the fluid flows into the mating channel 56. The fluid enters the impeller 3 from the mating channel 56, flows out radially through centrifugation of the impeller 3, and then flows into the water pump volute 212 of the pump cavity. The mating channel 56 forms the gap with the outer side of the impeller 3, and cooperates with the impeller 3 to form a narrow channel, which inhibits the backflow of the fluid after passing through the impeller 3, and improves the efficiency of the heating pump 100.

In some embodiments, the water inlet end cap 52 may have an axisymmetric structure with the water inlet end cap 52, the pump cavity 21, and the impeller 3 arranged coaxially, thereby enabling the water to flow uniformly and symmetrically through the water inlet end cap 52 and the impeller 3.

The heating member 4 is fixed to the first end of the heating cavity 22, and the end cap 5 (e.g., the water outlet end cap 53) is fixed to the second end of the heating cavity 22 to seal the second end of the heating cavity 22. During the mounting of the heating pump 100, the heating member 4 is extended into the heating cavity 22 from the second end of the heating cavity 22 and the heating member 4 is fixed to the first end of the heating cavity 22. After the heating member 4 is mounted, the end cap 5 is coupled to the pump casing 2 to seal the second end of the heating cavity 22. The end cap 5 can be fixed to the second end of the heating cavity 22 in various ways. In some embodiments, the end cap 5 is coupled to the second end of the heating cavity 22 by a non-removable way, and for example, the end cap 5 is fixed to the second end of the heating cavity 22 by welding. By coupling the end cap 5 to the second end of the heating cavity 22 in the non-detachable way, the sealing between the end cap 5 and the second end of the heating cavity 22 can be ensured without any sealing element. In other embodiments, the end cap 5 is removably fixed to the second end of the heating cavity 22. For example, the end cap 5 is coupled to the second end of the heating cavity 22 by screws, and a seal gasket is arranged between the end cap 5 and the second end of the heating cavity 22 to prevent the fluid in the heating cavity 22 from leaking out through a seam between the end cap 5 and the second end of the heating cavity 22. By removably fixing the end cap 5 to the second end of the heating cavity 22, the end cap 5 can be removed and the heating member 4 can be replaced or repaired in the event of a failure of the heating member 4, without the need to scrap the entire heating pump 100 when only the heating member 4 is damaged.

In some embodiments, as shown in FIG. 24, the water inlet end cap 52 and the water outlet end cap 53 are fixed as a whole, allowing the water outlet end cap 53 to be fixed to the second end of the heating cavity 22 while the water inlet end cap 52 is mounted, and simplifying the mounting of the heating pump 100. In other embodiments, the water inlet end cap 52 and the water outlet end cap 53 are two separate parts, and there is no interference between the water inlet end cap 52 and the water outlet end cap 53 during installation, reducing the requirement for machining accuracy of the water inlet end cap 52 and the water outlet end cap 53.

Embodiments of the present disclosure also provide a cleaning device. The cleaning device includes the heating pump 100 as described in the previous embodiments, and the cleaning device has a cleaning space for cleaning objects, a water inflow port of the cleaning space being coupled to the water outlet 24 of the heating pump 100.

In some embodiments, the cleaning device may be, for example, a dishwasher. Bowls are placed in the cleaning space, the heating pump 100 injects heated hot water with detergent into the cleaning space to wash the bowls, and then the heating pump 100 injects heated clean water into the cleaning space to rinse the bowls and flush away foam from the bowls to achieve a purpose of cleaning the bowls.

In other embodiments, the cleaning device may be, for example, a washing machine. Clothes are placed in the cleaning space, the heating pump 100 injects heated hot water with detergent into the cleaning space to wash the clothes, and then the heating pump 100 injects heated clean water into the cleaning space to rinse the bowls to achieve a purpose of cleaning the clothes.

Other configurations and operations of the heating pump 100 and the cleaning device having the same according to the embodiments of the present disclosure are known to those skilled in the art and will not be described in detail herein.

In the description of the present disclosure, it is to be understood that terms such as "thickness," "upper," "lower," "front," "rear," "left," "right," "vertical," "horizontal," "top," "bottom," "inner," "outer" and the like should be construed to refer to orientations or positions as then described or as shown in the drawings under discussion. These relative terms are for convenience of description and do not indicate or imply that the device or element referred to must have a particular orientation or be constructed or operated in a particular orientation. Thus, these terms shall not be construed as limitations on the present disclosure.

Reference throughout this specification to "an embodiment," "some embodiments," "an exemplary embodiment," "an example," "a specific example" or "some examples" means that a particular feature, structure, material, or characteristic described in connection with the embodiment or example is included in at least one embodiment or example of the present disclosure. Thus, the appearances of the phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives, and variations can be made in the embodiments without departing from principles and purposes of the present disclosure. The scope of the present disclosure is defined by the claims and their equivalents.

The invention claimed is:

1. A heating pump, comprising:

a drive motor;

a pump casing defining a pump cavity and a heating cavity in communication with the pump cavity, the pump cavity and the heating cavity being substantially arranged side by side in an axial direction, the pump cavity and the heating cavity being in communication with each other through a communication channel, and the pump casing being formed with a water inlet in communication with the pump cavity and a water outlet in communication with the heating cavity;

an impeller arranged in the pump cavity and coupled to a motor shaft of the drive motor;

a heating member arranged within the heating cavity; and an end cap formed with the water inlet, the end cap being hermetically coupled to the pump casing, wherein the end cap comprises:

a water inlet end cap, a second seal member being arranged between the water inlet end cap and the pump casing; and a water outlet end cap, a third seal member being arranged between the water outlet end cap and the pump casing, wherein the water inlet end cap comprises a mating slot, and the pump casing comprises a mating portion fitted in the mating slot, the mating portion comprises a second mounting groove for mounting the second seal member, and the water outlet end cap comprises a third mounting groove for mounting the third seal member.

2. The heating pump according to claim 1, wherein the communication channel extends tangentially along an inner wall surface of the pump casing.

3. The heating pump according to claim 1, wherein the communication channel is an expansion channel in a water flow direction, and an expansion angle of the expansion channel is not greater than 20 degrees.

4. The heating pump according to claim 3, wherein in the water flow direction, the pump cavity comprises an inlet connection section and a water pump volute, the expansion channel being formed between the water pump volute and the heating cavity.

5. The heating pump according to claim 3, wherein the pump casing comprises an outlet connection tube in communication with the heating cavity, and a free end of the outlet connection tube forms the water outlet.

6. The heating pump according to claim 5, wherein the outlet connection tube extends tangentially along an outer side wall of the heating cavity.

7. The heating pump according to claim 1, wherein the heating cavity comprises a first mounting groove at a bottom of the heating cavity, and a first seal member is arranged in the first mounting groove.

8. The heating pump according to claim 1, wherein the heating member is a heating tube extending spirally, and a spiral direction of the heating tube is consistent with a water flow direction.

9. The heating pump according to claim 1, wherein the heating member is a thick film on an inner wall surface of the heating cavity.

10. The heating pump according to claim 1, wherein a flow guide rib is arranged on an inner wall surface of the heating cavity, and an extension direction of the flow guide rib is consistent with a water flow direction.

11. The heating pump according to claim 1, wherein:

the motor shaft is formed with an outer thread and the impeller is formed with an inner thread;

the drive motor and the impeller are coupled by fitting between the outer thread and the inner thread; and a spiral direction of the inner thread or the outer thread is opposite to a rotation direction of the drive motor.

12. The heating pump according to claim 1, wherein:

in a water flow direction, a water inlet channel, a rectification channel, and a mating channel are defined at an inner side of the end cap, and a water inlet end of the water inlet channel forms the water inlet; and the impeller is arranged at the mating channel and is spaced apart from an inner wall surface of the mating channel to define a return channel for return water flow between the impeller and the mating channel.

13. The heating pump according to claim 12, wherein a sealing protrusion is formed on an outer wall surface of the water inlet channel to connect a water inlet hose.

14. The heating pump according to claim 12, wherein in a water flow direction, an inner wall surface of the rectification channel is constructed in a shape with a gradually reduced radial dimension.

15. The heating pump according to claim 1, wherein a longitudinal section of the communication channel exhibits an axisymmetric shape.

16. The heating pump according to claim 1, wherein the pump casing has an inner wall surface and an outer wall surface that form the communication channel, and the outer wall surface of the communication channel is tangential to a wall surface of the heating cavity.

17. The heating pump according to claim 1, wherein the pump casing has an inner wall surface and an outer wall surface that form the communication channel, and at least one of the inner wall surface and the outer wall surface is a flat surface.

18. The heating pump according to claim 1, wherein the pump casing comprises a partition wall separating a hole formed by the pump cavity, the impeller, and a water pump volute of the pump cavity from the heating cavity.

* * * * *